US009592177B2

(12) United States Patent
Nour

(10) Patent No.: US 9,592,177 B2
(45) Date of Patent: Mar. 14, 2017

(54) CIRCULATORY FLOW RESTORATION DEVICE

(71) Applicant: Sayed Nour, Chaville (FR)

(72) Inventor: Sayed Nour, Chaville (FR)

( * ) Notice: Subject to any disclaimer, the term of this patent is extended or adjusted under 35 U.S.C. 154(b) by 727 days.

(21) Appl. No.: 13/685,537

(22) Filed: Nov. 26, 2012

(65) Prior Publication Data

US 2014/0148739 A1 May 29, 2014

(51) Int. Cl.
*A61H 9/00* (2006.01)
*A61H 31/00* (2006.01)

(52) U.S. Cl.
CPC ..... *A61H 31/006* (2013.01); *A61H 9/0078* (2013.01); *A61H 2201/165* (2013.01); *A61H 2205/083* (2013.01); *A61H 2205/084* (2013.01)

(58) Field of Classification Search
CPC .. A61H 9/0007; A61H 9/0078; A61H 9/0092; A61H 31/00; A61H 31/004–31/007; A61H 2031/003; A61H 2201/1619; A61H 2201/1621; A61H 2205/083; A61H 2205/084; A61H 2205/081
See application file for complete search history.

(56) References Cited

U.S. PATENT DOCUMENTS

| | | | | |
|---|---|---|---|---|
| 3,896,797 | A * | 7/1975 | Bucur | 601/106 |
| 4,397,306 | A | 8/1983 | Weisfeldt et al. | |
| 4,424,806 | A | 1/1984 | Newman et al. | |
| 5,490,820 | A * | 2/1996 | Schock | A61H 9/0078 601/1 |
| 5,769,800 | A * | 6/1998 | Gelfand | A61H 9/0078 601/151 |
| 6,010,470 | A * | 1/2000 | Albery et al. | 601/152 |
| 6,361,512 | B1 * | 3/2002 | Mackay et al. | 601/150 |
| 2005/0126578 | A1 | 6/2005 | Garrison et al. | |
| 2006/0047228 | A1 | 3/2006 | Petelenz et al. | |
| 2007/0088235 | A1 * | 4/2007 | Tseng | 601/151 |
| 2010/0326442 | A1 * | 12/2010 | Hamilton et al. | 128/204.21 |
| 2011/0098611 | A1 | 4/2011 | Flood | |
| 2011/0098616 | A1 * | 4/2011 | Ben-Nun | 601/151 |
| 2011/0295163 | A1 * | 12/2011 | Vijayanagar | 601/18 |
| 2014/0066822 | A1 * | 3/2014 | Freeman | 601/41 |
| 2015/0025425 | A1 * | 1/2015 | Mitchell | 601/96 |
| 2015/0272821 | A1 * | 10/2015 | Nour | A61H 9/0078 601/152 |

FOREIGN PATENT DOCUMENTS

| | | |
|---|---|---|
| WO | WO 94/20060 A1 | 9/1994 |
| WO | WO 98/17224 A1 | 4/1998 |

* cited by examiner

*Primary Examiner* — Valerie L Woodward
(74) *Attorney, Agent, or Firm* — Knobbe, Martens, Olson & Bear, LLP

(57) ABSTRACT

Disclosed is a circulatory flow restoration (CFR) device that includes an abdominal pressure element configured to be arranged at or around a patient's trunk and including at least one unit capable of exerting pressure on patient's body, a thoracic pressure element configured to be placed at or around a patient's thorax and including at least one unit capable of exerting pressure on the patient's body, and a pulsatile generator. The present circulatory flow restoration (CFR) device may be used in cases of cardiac arrest. Also disclosed are methods of restoring heart beat in a patient.

12 Claims, 15 Drawing Sheets

REPLACEMENT SHEET

2/15

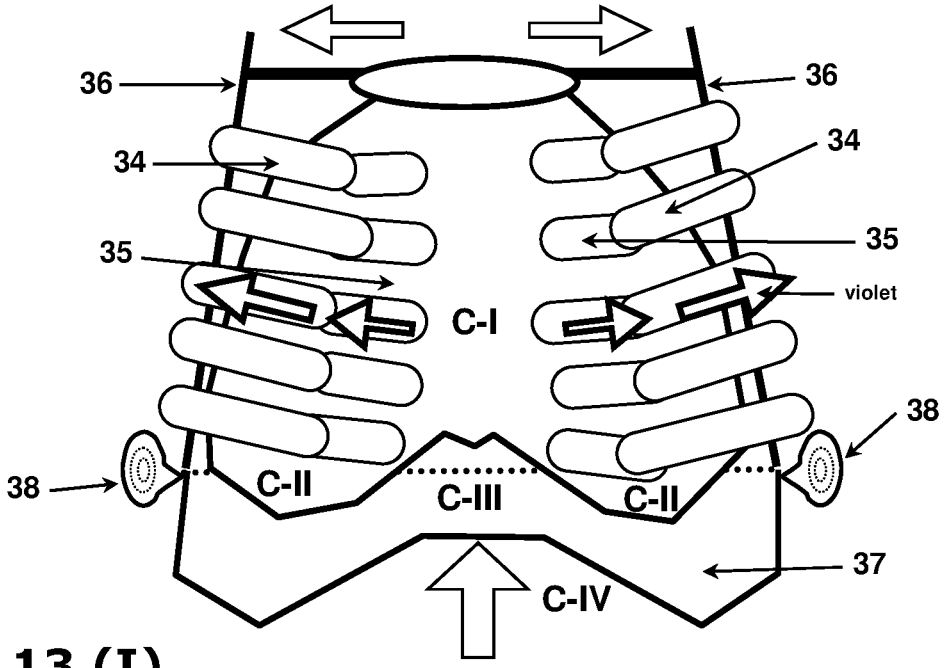
Fig. 13 (I)
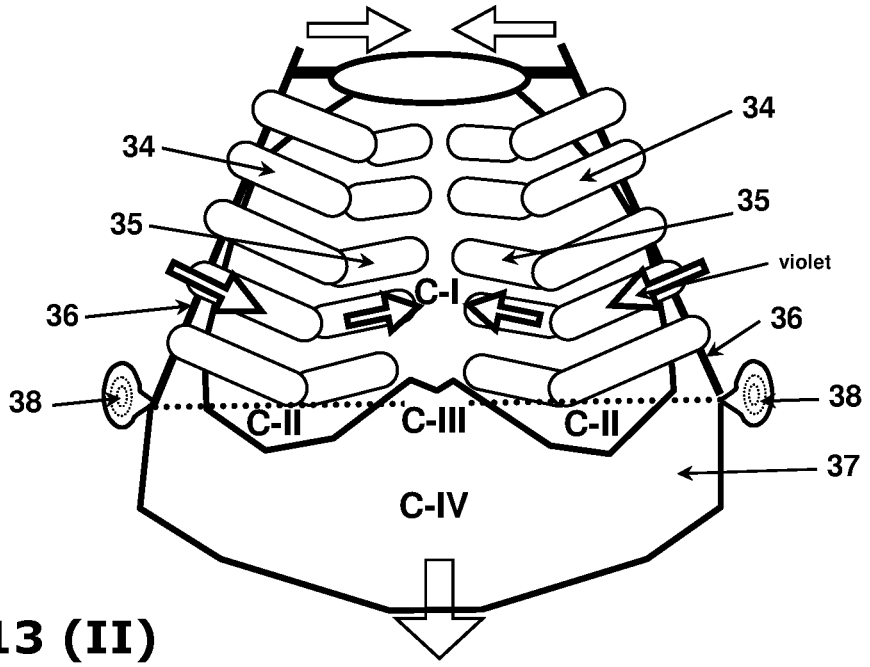
Fig. 13 (II)

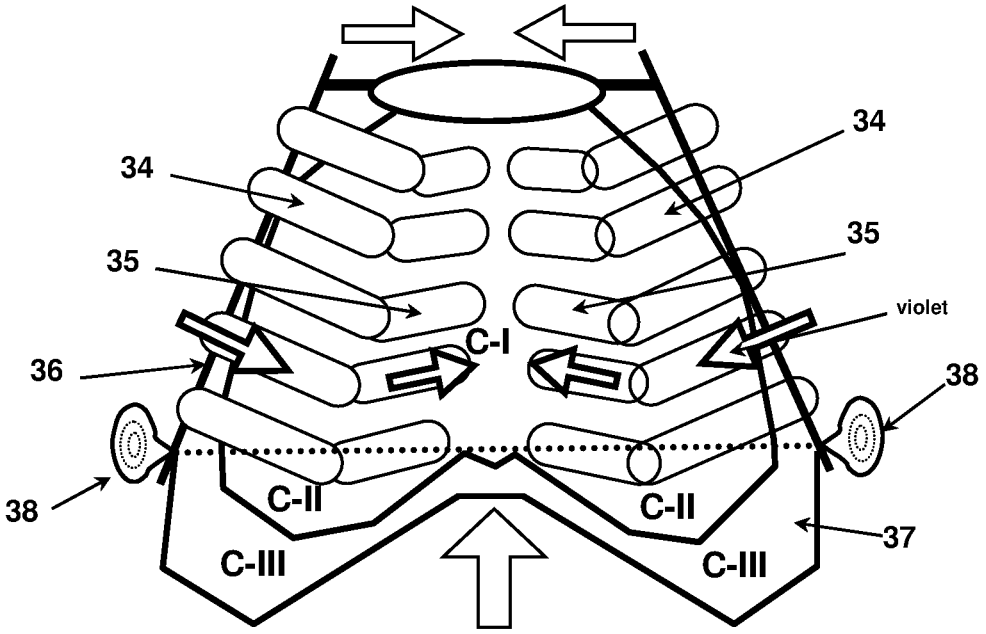
Fig. 13 (III)
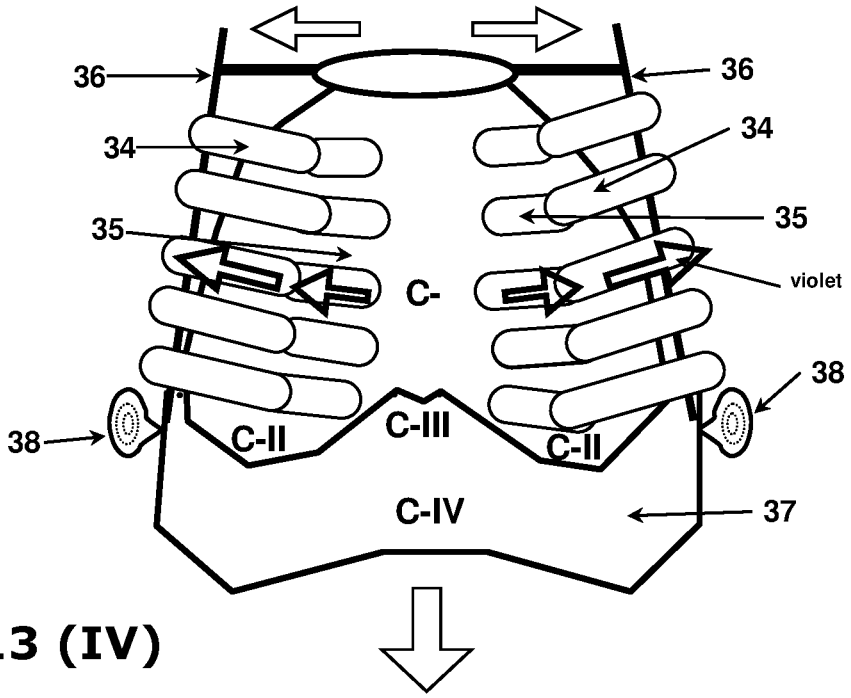
Fig. 13 (IV)

CIRCULATORY FLOW RESTORATION DEVICE

FIELD OF THE INVENTION

The present invention pertains to the field of medical devices and in particular to a circulatory flow restoration (CFR) device comprising an abdominal pressure element, a thoracic pressure element, and a pulsatile generator. The present circulatory flow restoration (CFR) device may be used in cases of cardiac arrest.

BACKGROUND OF THE INVENTION

Sudden cardiac arrest (SCA) is based on the cessation of normal blood circulation due to failure of the heart to contract effectively, which most often leads to death (Sudden cardiac death (SCD) within less than one hour from the onset of symptoms. In the United States yearly about 600,000 people encounter a sudden cardiac arrest (SCA) with a mortality rate of about 460,000 people. SCA and SCD are frequently associated with cardiac arrhythmia, distinct from heart attacks, which are usually preceded by symptoms and signs.

Individuals that encounter sudden cardiac arrest (SCA) and/or sudden cardiac death (SCD) may be practically classified in three groups:

The first group includes individuals exhibiting cardiac disorders comprising mechanical pump failure. These patients show of myocardial ischemia with 80% of SCA; valvulopathy; hypertrophic cardiomyopathy (HCM); congenital anomalies; myocarditis; ruptured LV aneurysm; ruptured mitral papillary muscle; operative complications, Uhl's syndrome; acute intra-cardiac thrombosis; trauma, etc.; and electrical pump failure such as fibrosis of the His-Purkinje system; arrhythmogenic right ventricular dysplasia (ARVD) syndrome [Marcus]; prolonged Q-T interval syndromes; drugs; electrolytes abnormalities; hypothermia; Idiopathic ventricular fibrillation, etc.

The second group includes individuals exhibiting extracardiac disorders, comprising ailments of the central nervous system (CNS), the respiratory system, the vascular system, and the metabolic system. Examples for disorders of the CNS are cerebral edema; hemorrhage; tumor; meningitis; encephalitis; cerebral abscess; trauma; stroke; drugs; toxins; chemoreceptors—sympathetic and parasympathetic troubles, etc. Examples for respiratory disorders are pulmonary embolism; asthma; Eisenmenger syndrome; acute inflammatory and/or infection of the respiratory tract i.e. pharyngitis; laryngitis; tracheobronchitis; toxic inhalation i.e., carbon monoxide poisoning; drowning; Asphyxia; food aspiration; laryngospasm; etc. Examples for vascular disorders are massive hemorrhage due to trauma, dissecting or ruptured aortic aneurysm; hemoglobinopathy; mechanical obstruction venous return i.e. acute cardiac tamponade; etc. Examples for metabolic disorders are inflammatory syndromes, degenerative neuromuscular diseases; diabetic coma; electrolytes disturbances (e.g. hypo- or hyperkalemia, hypercalcemia (stoney heart); hypo- or hyperthyroidism; etc.

The third group includes individuals exhibiting miscellaneous disorders, such as Choking or Cafe coronary syndrome; postpartum amniotic fluid air embolism; alcohols; septicemia; sleep apnea; natural (i.e., advanced age >90 years); anaphylactic shock; homicides; electrocution; blunt head or chest traumatic shock (commotio cordis); Hypothermia/hyperthermia; extreme physical exercise (e.g. due to HCM in athletics <35 years and IHD in athetics >35 years); withdrawal syndrome; smokers, emotional factors (e.g. stress, depressions, etc.).

Presently known treatments of sudden cardiac arrest (SCA) usually involve cardiopulmonary resuscitation (CPR) and emergency cardiovascular care (ECC). These treatments imply a number of activities which may be subdivided in essentially five groups: cardiac massage, pharmacological supports, electrical (DC) shock, post-resuscitation Care and prophylaxis.

1.) Cardiac Massage:

a) Manual or standard CPR, usually performed by bystander with external compression of the chest wall at the midsternal level, and interrupted by ventilation assist in a compression/ventilation ratio of 30:2. High-Frequency (Rapid Compression Rate≈100 compressions per minute) may improve hemodynamics and 24-hour survival compared with standard CPR.

b) Mechanical CPR as an alternative technique to manual standard CPR with devices such as mechanical Piston CPR adapted to depress the sternum for optimizing chest compression and reducing rescuer fatigue. There exist a number of ways of performing mechanical CPR:

(i) Vest CPR, a circumferential thoracic vest that contains a pneumatic bladder to compress the chest in inflation/deflation rhythmic cycles assisted by an electromechanical generator. The device may be equipped with flat defibrillator electrodes, cutaneously positioned at the anterior chest wall and connected to an ECG control system.

(ii) AutoPulse, consisting of a board containing a motor, rechargeable batteries, and an 8-inch wide belt. The board is placed underneath a heart attack victim and the belt is strapped across the victim's chest. Once the device is turned on, the motor alternatively retracts the belt, producing chest compressions. The AutoPulse is lighter than the CPR vest (20 vs. 80 pounds), and able to produce up to 80 compressions per minute. The system could operate for 30-60 min on a single set of rechargeable batteries. FDA recognizes the system for application in USA.

(iii) Interposed abdominal compression (IAC-CPR) including manual compression of the abdomen by an extra rescuer during the chest compression. The interposed abdominal compression (IAC-CPR) uses a point located in the midline, halfway between the xiphoid process and the umbilicus. The abdominal compression should be strong enough to compress the abdominal aorta and vena cava (≈100 mmHg).

(iv) Phased Thoracic-Abdominal Compression-Decompression (PTACD-CPR, Lifestick) comprising a rigid frame attached to 2 adhesive pads. A smaller pad (20×17 cm) is placed on the mid-sternum, a larger pad (37×25 cm) on the epigastrium. The pads are fixed to the Lifestick prior to its placement on the patient. The Lifestick is used in a 15:2 compression-ventilation ratio, at 60 cycles per minute. The system is equipped with a metronome-driven 240° thoracic-abdominal phase shift (waltz-timing) as an indicator for optimal hemodynamic response. Also, it is equipped with a Tactile pressure indicator system to guide the abdominal compression force was limited to 18 to 28 kg (controlled by a colored LED display on the top of the frame). The display for the chest forces can be switched from a low (28 to 45 kg) setting to a medium (41 to 63 kg) or a high (54 to 82 kg) setting to achieve the target compression depth of 4 to 5 cm.

(v) CD-CPR (active compression-decompression-CPR) by decreasing the intrathoracic pressure during decompression phase of CPR is thought to enhance venous return and thereby "prime the pump" for the next compression. ACD- CPR is performed with a hand-held device equipped with a suction cup to actively lift the anterior chest during decompression.

(vi) Impedance Threshold Valve (ITV, or ResQ-Valve), which is associated with a lower intrathoracic pressure. When used with a compression/decompression device, the valve is inserted into a standard tracheal tube ventilation circuit and does not disrupt CPR performance. By preventing inspiration during chest decompression, the impedance threshold valve produces more negative intrathoracic pressure, enhancing blood return to the thorax.

(vii) Invasive CPR, in special situations of SCA, which require a direct cardiac massage through a thoracotomy or sternotomy incision.

(viii) Emergency cardiopulmonary bypass (CPB), which may be applied by a femoro-femoral technique without requiring a thoracotomy. Associations of hypothermia with CPB could improve neurologic outcome in certain occasion of SCA.

2.) Pharmacological Supports:

Direct intracardiac injections (ICI) of drugs (e.g., epinephrine, vasopressin and sodium bicarbonate), usually given by trained medical staff, through-into the right ventricle, and followed by continued external cardiac massage.

3.) DC Shock:

Using a standard external defibrillator device to deliver a transthoracic electrical shock for restoring normal cardiac rhythm which usually involves the use of hand-held paddle electrodes or self-adhesive patch electrodes. Paddles are usually placed in an anterolateral position between the ventricular apex and the right infraclavicular area. In the anteroposterior position, paddles are placed over the sternum and the interscapular space. Additional devices may be such as: a) Automated external defibrillators (AEDs) being portable special defibrillators that untrained bystanders may use. The AEDs are programmed to give an electric shock if they detect any dangerous arrhythmia and prevent giving an unnecessary shock to someone who may have fainted. b) Implantable cardioverter defibrillator (ICD) which is a pacemaker like device having wires with electrodes on the ends that connect to the heart's chambers (right atrium and right ventricle). If the ICD detects a dangerous heart rhythm, it will give an electric shock to restore the heart's normal rhythm. Patients might need medicinal support to avoid irregular heartbeats that can trigger the ICD.

4.) Post-Resuscitation Care:

After initial CPR, victims require support to restore cardiac and organ functions. These include a hemodynamic support, prevention of hyper or hypothermia, control of blood sugar and avoiding a routine hyperventilation. As more than half of post-resuscitation syndrome deaths occur within 24 hours after the ROSC, due to dysfunction of the microcirculation, this leads to metabolic disorders eventually resulting in multiple organs failure.

5.) Prophylaxis:

Procedures such as the microvolt T-wave alternans (TWA), and programmed ventricular stimulation (PVS) may represent a promising approach to predict fatal arrhythmias in high-risk ischemic heart diseases patients.

Even though a number of devices and means adjunctive to standard manual CPR have been shown to improve the efficacy of CPR in SCA patients, the survival rate still remains quite poor. These drawbacks are deemed to be caused at least in part by non appropriately selected resuscitation methods and therapeutic concepts.

In selecting a particular concept attention is to be given to cardiovascular physio-pathology, the cardiothoracic anatomy, and the hemodynamics/hemorheology.

The contraction of the cardiac muscle is initiated by electrical impulses, which are the result of polarization/depolarization mechanisms of particular cardiac cells (termed pacemaker cells). These pacemaker cells represent only one percent (1%) of cardiac cells and create rhythmical impulses that are transferred from said through a conducting system and adjacent cells.

Anatomically, the electrical impulses creating system of the heart is composed of three entities: a) the sinoatrial node (SA node—the primary pacemaker zone), which is positioned on the wall of the right atrium (near the entrance of the superior vena cava); b) the atrioventricular Node (AV node—the secondary pacemaker zone), localized near the apex of the triangle of Koch inside the right atrium; and c) the bundle of His and Purkinje fibers, which are the continuity of the electrical conducting system of the heart.

The pacemaker cells spontaneously depolarize, giving a native rate of about 100 bpm, which rate is controlled and modified by the sympathetic and parasympathetic autonomic nervous system, resulting in heart rate in an adult individual of around 70 bpm. If the SA node does not function the AV node (secondary pacemaker) will step in producing a spontaneous heart rate of around 40-60 bpm. If both, the primary and secondary pacemakers fail to produce electrical signals the HIS and the Purkinje fibers will produce a spontaneous action potential at a rate of about 30-40 beats per minute.

The heart beat as such is normally controlled only by the SA node in that its action potentials are released more often. The action potential generated by the SA node passes down the cardiac conduction system, and arrives before the other cells had a chance to generate their own spontaneous action potential.

For the generation of an action potential a pacemaker cell moves through 5 phases (numbered 0-4): Phase 4 is characterized by the resting membrane potential (−60 mV to −70 mV), which is caused by a continuous outflow potassium ions through ion channel proteins in the cells membrane. During Phase 0 a rapid depolarization occurs, which is mainly caused by an influx of $Na^+$ and $Ca^{2+}$ ions. During Phase 1 the $Na^+$ channels are inactivated due to the movement of $K^+$ (efflux) and $Cl^-$ ions. Phase 2 represents a "plateau" phase of the cardiac action potential due to a balanced influx of $Ca^{2+}$ and efflux of $K^+$ ions. During Phase 3 a "repolarization" of the action potential occurs, with closure of the $Ca^{2+}$ channels, and slowing of $K^+$ efflux.

As is appreciated a heartbeat depends on a reaction on/within the membranes of pacemakers cells.

This reaction may be induced by a sudden filling of the empty right atrium, effecting direct snapping impacts at the membranes of the pacemaker cells, and also indirectly by wall stretching. In other words, a heartbeat primarily depends on an endothelial elastic membrane function mediated by shear stress which stress is induced by blood flow dynamics at the right heart cavities. The first heartbeat in a human appears around the $21^{st}$ gestational day, induced by the direct effect of the placental circulation endothelial shear stress (ESS) and maternal neurohumoral factors upon the right atrium pacemaker cells. Afterwards heartbeat will continue and be maintained by blood flow that stimulates the pacemaker cells mechanically via the pulsatile impacts of shear stress, and/or chemically with combinations of neurohumoral factors and electrolytes channels.

In case of a cardiac arrest the main target for reviving blood circulation is to stimulate the pacemaker cells inside the right atrium first, which is, however, difficult to achieve with current CPR methods. As is known (and shown in FIG. 1), the sternum is separated from the heart by several centimeters. As a result chest compressions must be strong enough to compress the hard thoracic cage (1, 2), and then also the mobile soft mediastinal and cardiac structures up to the thoracic aorta (6), which is located almost far backward on the dorsal vertebrae (7). However, any revival of cerebral and coronary circulation flow depends on systemic arterial blood flow ejected by the left ventricle (4), following a left atrium (8) preload. Anatomically, the left cardiac cavities are positioned posterior to the right heart chambers, which means that the systole of the compressed right ventricle will be delivered first into the pulmonary circulation to follow the normal cardiac cycle. The pulmonary circulation collapsed due to cardiac arrest refutes this unrealistic imagination of systemic preload-afterload dependency of cardiac massage.

Hence, due to the anatomical position of the heart currently used cardiac massages have few chances of triggering a heartbeat. In addition, these current procedures repeat successive chest blows—regardless of the physiological action potential of the cardiac phases—which may even lead to a commotio cordis or a re-arrest of the heart.

A human adult contains roughly 4-6 l blood, with the venous system holding almost about 70-80% of the blood volume. An adult heart harbors around 400-500 ml, and the systemic arteries about 3-5% of the blood volume.

Under operation conditions the heart and the blood circulation system create a (blood) pressure, which is endogeneously higher in the arteries than in the venous system. Within about 30 seconds following a sudden cardiac arrest the cardiovascular pressure is equalized in the blood circulatory system since the arterial pressure falls and the venous pressure rises as some of the arterial blood moves into the veins during pressure equalization.

During CPR an elevated coronary perfusion pressure (CPP) of at least 15 mm Hg is required for return of spontaneous circulation (ROSC). It seems almost impossible to restore metabolic processes and organ perfusions properly by compressing such few amounts of stagnant intra-ventricular blood volume (about 400 ml), unequally divided between left and right cardiac chambers. Consequently blood flow during CPR is usually inadequate to ensure vital organs perfusions.

Drawbacks of the devices currently applied, such as manual or piston CPR, include a limitation of recoil of the thorax as well as venous return during decompression. Interferences with defibrillation efforts may occur which may cause re-ventricular fibrillation (e.g. commotio cordis). Rib fractures occur frequently, as well as cardiac injury and pericardial tamponade due to extra force and energy applied to the chest wall during ACD-CPR. Devices such as the IAC-CPR are contraindicated in patients with aortic aneurysms, pregnancy, or recent abdominal surgery. Almost all mechanical devices are limited to in-hospital resuscitations requesting trained staff with considerable costs. The efficacy and safety of mechanical devices have not been demonstrated for infants and children, their use is still limited to adults. The FDA does not approve most of the current CPR mechanical devices. Invasive CPR is still limited to in-hospital patients with specific indications including i) cardiac arrest caused by hypothermia, pulmonary embolism, or pericardial tamponade; ii) chest deformity where closed-chest CPR is ineffective; and iii) penetrating abdominal trauma with deterioration and cardiac arrest. The use of open-chest direct cardiac massage can be considered under special circumstances but should not be performed simply as a late last-ditch effort.

There are also drawbacks associated with pharmacological supports. As is acknowledged intra and extracellular electrolytes play a crucial role in the heartbeat mechanism and are usually disturbed by SCA. Current IV pharmacological CPR supports are ineffective due to a stagnant circulation. Drug treatment by direct ICI technique is also less effective and associated with quite annoying side effects. Furthermore, a prospective randomized controlled trial confirmed that routine use of high-dose epinephrine was not beneficial and may actually increase rates of morbidity and mortality.

The benefits of DC shock are still debated, as controversies between chest compression first versus DC shock first remain unresolved. This is mainly due to the fact that most SCA victims demonstrate a non-perfusion phase (prolonged depolarization) for several minutes, which necessitates immediate massage. A successful DC shock must be strong enough to affect pacemaker cells that represent only about 1% of cardiac myocytes. A prolonged depolarization after strong shocks may cause myocardial necrosis caused by an electroporation, i.e. a rupture of cardiac cell membrane. An associated tachyarrhythmia is one of the most common complications associated with DC shocks, which is contraindicated in case of digitalis toxicity. Thromboembolic accidents are more likely to occur in patients with atrial fibrillation (AF) who have been treated with DC shocks without proper anticoagulation. Painful skin burns have been reported for 20-25% of patients after DC shocks due to technical reasons. This is usually attributed to the paddles size, skin-to-electrode contact and waveforms types (i.e. monophasic or biphasic). Some studies have confirmed that the anteroposterior position DC shock is superior because it requires less energy to reverse AF. In a matter of fact, only 4% to 5% of the shocking energy actually reaches the heart due to deviation of this electric field. Also, pulmonary edema has been reported after DC shocks.

In the prior art a number of medical devices for assisting during/after a cardiac arrest which do not focus on chest compressions are known.

WO 2008/000111 discloses a neonate or infant pulsating wear to obtain the puls. The wear exhibits a multilayer structure comprising an elastic inner layer contacted with the body of the infant, an outer layer isolating the body of the infant, and a middle layer between the inner layer and the outer layer. Said middle layer contains a pulsant cyclic liquid and the outer layer is harder than the inner layer.

WO 2010/070018 pertains to a pulsatile and non-invasive device for circulatory assistance, which device promotes the circulation of a volume of blood in the body of a subject. The device comprises a flexible multi-layer structure designed to be applied to at least a part of the subject's body and exhibits a flexible inner layer towards the body of said subject and a more rigid outer layer. Pulsation means are connected to said multi-layer structure in such a way that the assembly composed of the structure and of the pulsation means is leak-tight. Utilizing the pulsation means pulsations are created between said inner and outer layers by way of a pulsation fluid. Each of the pulsations propagate progressively in the direction of venous return along that part of the body of said subject when said structure is arranged to this particular part of the body.

US 2012/0232331 discloses a circulatory assist device (CAD) that is minimally invasive and which improves the hemodynamics, i.e. the overall microcirculation in organs, and the restoration and preservation of deficient endothelial function in a patient. The device must be placed externally to the patient's body and connected by at least a pipe and/or a specific connection element to increase the preload of the right ventricle so as to improve oxygenation of the myocardium and so as to improve its contractility, and/or unload the left ventricle and diffuse regular pulsatile flow in the proximity of the aortic root so as to improve the hemodynamics of the left ventricle of the heart, and/or stimulate the endothelium mechanically by shear stress enhancement so as to release several mediators of endothelial vasodilators like nitric oxide, to reduce the systemic and pulmonary afterload.

WO 2009/153491 relates to a device for applying a predetermined pulsatile pressure to a medical device. The disclosed device comprises a withdrawing means designed to withdraw fluid from a source of fluid in continuous flow at high pressure, a conversion means designed to convert said fluid into a fluid in a pulsatile flow at low pressure, at least one application means for applying said fluid as a low-pressure pulsatile flow to said medical device, and a means for removing said fluid.

Yet, there still exists a need in the art for a device that improves the outcome of a CPR treatment.

SUMMARY OF THE INVENTION

The present invention provides a new mechanical device capable of stimulating specific areas in the heart in a manner to move stagnant fluids—particularly blood—to induce a shear stress movement action in the pacemaker cells (e.g. SA node area).

In its widest sense the present device comprises at least one abdominal pressure element (infradiaphragmatic device), at least one thoracic pressure element, and at least one pulsatile generator. The abdominal pressure element is adapted to be placed around a patient's trunk and comprises at least one of compressing/decompressing unit. The thoracic pressure element is adapted to be placed around a patient's chest and comprises at least one compressing/decompressing unit. The at least one compressing/decompressing units of both of the pressure elements are in electrical and/or fluid connection with the at least one pulsatile generator which conveys impulses to the compressing/decompressing units so that the units may exert pressure on the patient's body.

The pressure element may have any suitable form, for example the form of a layer or sheet having a thickness allowing the arrangement of the compressing/decompressing unit. The said layer/sheet may be adjacent to at least one inner layer facing the patient and/or at least one outer layer facing the environment.

According to a specific embodiment of the present invention, the outer layer is made of an essentially rigid material, while the inner layer is made of a flexible and preferably soft material. Examples of an essentially rigid material include but are not limited to polycarbonate or equivalent materials which are light and resistant. Examples of a flexible and preferably soft material include but are not limited to materials biocompatible with patients' skin, e.g. polyurethane or equivalent materials.

The abdominal pressure element may be in form of a belt, or in form of a trouser or diaper.

The thoracic pressure element may be designed like a belt, or a shirt or a vest which may be closed by appropriate means.

According to another embodiment, the at least one pulsatile generator is either pneumatic or electromechanic or both.

According to an embodiment of the present invention, the circulatory flow restoration device is adapted to be placed into a briefcase like container. Preferably, the container also comprises a standard medic first aid kit and/or an instruction manual.

According to an embodiment of the present invention, the pulsatile generator triggers the compressing/decompressing units of the abdominal pressure element first before triggering the thoracic pressure element.

According to another embodiment the pulsatile generator triggers both pressure elements consecutively and alternating in a frequency of about 40 to 50 per minute, preferably at about 40 bpm and at a low compressing pressure, e.g. at about 0.5-2 bars, preferably 0.8-2 bar, more preferably at about 0.8-1.5 bar, which both of which (the bpm and the pressure) will be adapted according to patients morphological features, e.g. children, obese, etc.

According to another embodiment, the at least one pulsatile generator is located on or at either the abdominal pressure element or the thoracic pressure element. Alternatively, the at least on pulsatile generator is located remote from both pressure elements, e.g. linked to the container.

and Groin (26) grooves with their protection pads; Pliable-extensible compartments (29), allowing adjustments of the device length; Zipper like systems (33), allowing adjustments of the device width.

Figure 6:
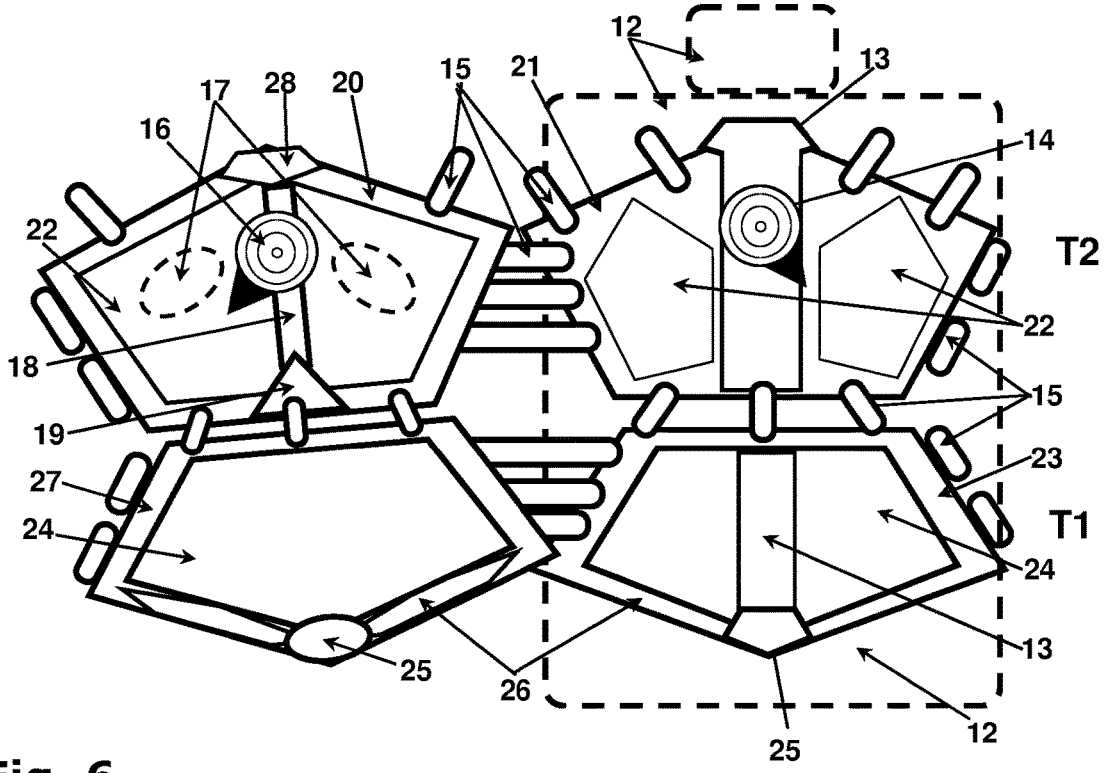

FIG. 6 is an inner view of an embodiment of the present invention showing: 12=deployed trolle; 13=dorsal thoracic and lumbar vertebral protector pads; 14=interscapular defibrillator adhesive patch; 15=adjustable intersectional-connectors strap-pads; 16=a retrosternal defibrillator adhesive patch; 18=retrosternal pad; 19=epigastric protector bars; 20=anterior external shell of "T2"; 21=posterior external shell of "T2"; 22=inflatable posterior pads of "T2"; 23=posterior external shell of "T1"; 24=inflatable posterior pads of "T1"; 25=genital protector-groove; 26=groin protector-groove; 27=anterior shell of "T1"; 28=manibural-suprasternal groove. "La Mallette" internal view, showing: a deployed trolley (12); dorsal thoracic and lumbar vertebral protector bar (13); Interscapular defibrillator pad (14); Adjustable intersectional-connectors straps-pads (15), which could be inflated in a lifejacket manner to make device wrapping tightly around the victim chest and trunk; a retrosternal defibrillator pad (16); mammary grooves (16); retrosternal (18) and xiphoid (19) protector pads; anterior external shell (20) of "T2"; Posterior external shell (21) of "T2"; inflatable posterior pads (22) of "T2"; Posterior external shell (23) of "T1"; inflatable posterior pads (24) of "T1"; genital protector-groove (25); groin protector-groove (26), both grooves may allow medical instrumentation, e.g., urinary catheter, rectal probe, femoral arterial or venous lines; Anterior shell (27) of "T1"; manibural-suprasternal groove (28).

Figure 7:
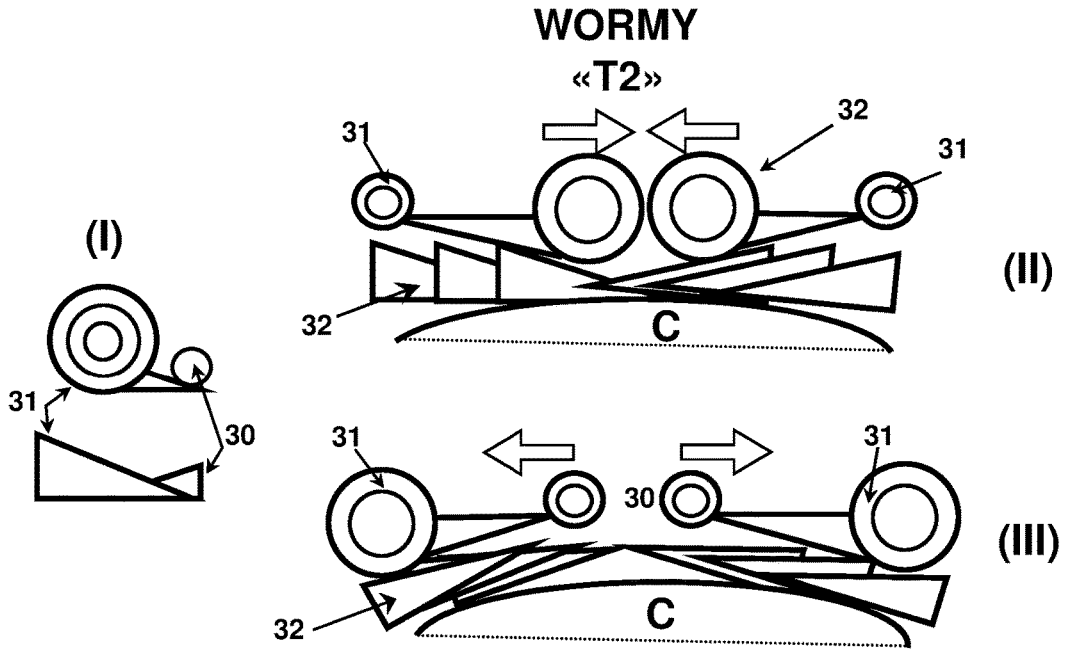

FIG. 7 represents a further embodiment of the present invention comprising several units. Each unit (I) comprises two balls (30 & 31) located at each extremity, made of rigid and extensible materials. Each unit extremity is unequally prefilled with compressible fluid that could be plied in a helical coil form allowing its spreading on/off rapidly to compress the underneath pads (32) located in the inner layers. "Wormy" system, which is composed of several units. Each unit of wormy system as shown in (FIG. 7-I) is prefilled with fluid unequally at each extremities, i.e., two balls, helical form (30 & 31), made of rigid and extensible materials, to compress underlying pads (32) located in the inner layers. Each unit is prefilled with compressible fluid that could be plied in a helical coil form allowing its spreading on/off rapidly. The system is direct connection to a rhythmic pneumatic and/or an electro-mechanic generator. The system is sandwiched in an intermediate chamber composing a space between the outer shell and the inner layer. The main function of the intermediate chamber is transmitting the pressurized impacts triggered by the corresponding generator inward into the inner layer, in respecting the requested axis and direction of flow. A symbolic example in the chest vest (T2), the requested axis must be horizontal within the physiological thoracic pump axis. Meanwhile, the axis in the infradiaphragmatic compartment (T1), direction should be vertical in the direction of venous return. These allow wormy system to squeeze the thoracic cage (C), performing controlled rhythmic contracting (upper panel, II) and decontracting (lower panel, III) movements. These could be used as a noninvasive mechanical respiratory assist device, as well. These detailed descriptions of thoracic (T2) and/or infardiaphragmatic (T1) compartments are unlimited once the main concept is maintained, meaning alternative squeezing movement of (T1) and (T2) started and always started by (T1). Accordingly, and in a matter to adapt with different body sizes (e.g., newborns, paediatrics, adults from both sex). The wormy systems could be two balls, helical, hourglass, spiral etc., within the respect of guided and rapid transfer of growing compressed wave forth and back according to the requested axis, i.e., horizontally oblique on the chest and vertical on the trunk and infradiaphragmatic regions. Wormy will compress the underlying structures e.g. prefilled fluid pads inward toward the patient's body.

Figure 8:
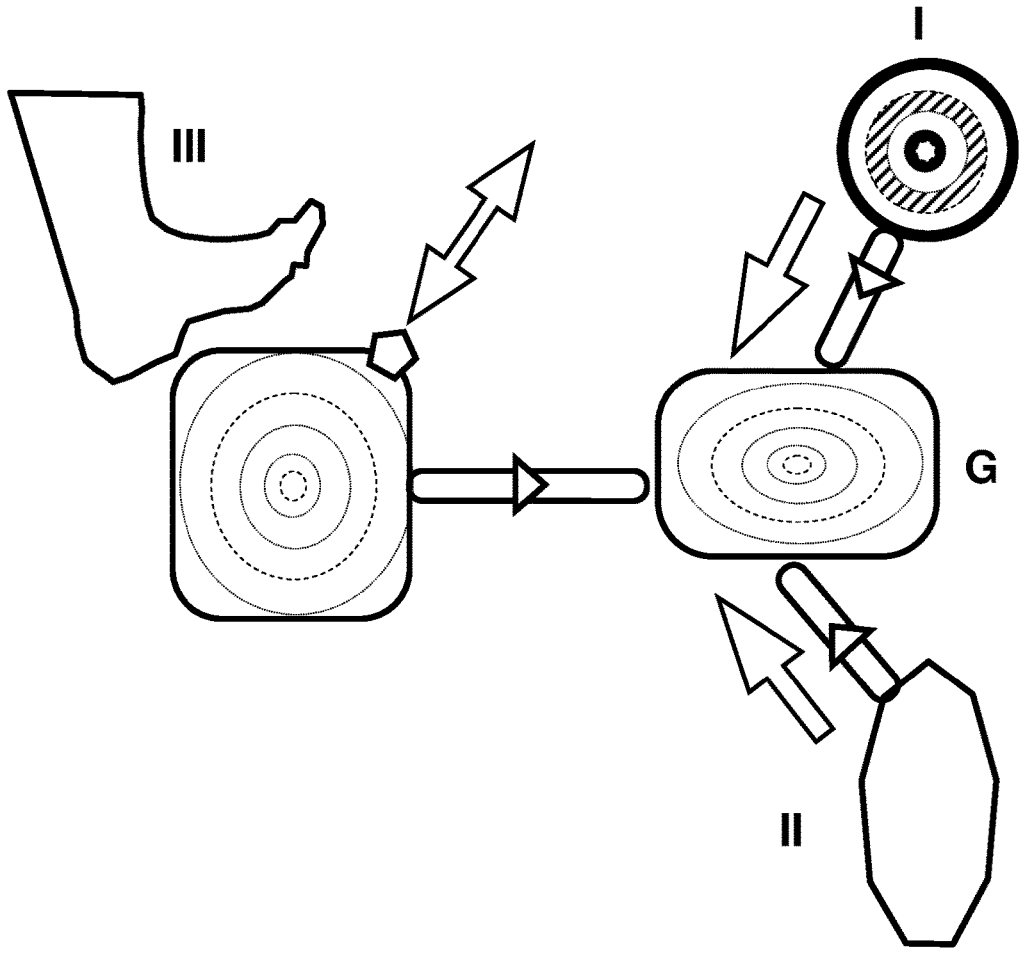

FIG. 8 shows a rhythmic generator (G), and different sources of pressurized hyperbaric fluid alimentation such as: wall air in hospital setting (I); hyperbaric bottles (II); or atmospheric air reservoir (III), which could be filled manually and/or with compressor. The fluid may be air or liquid e.g., seawater in case of drowning. The generator (G), could be connected directly to its source with high pressure flexible hose equipped with unidirectional monovalve. Rhythmic generator (G), and different sources of pressurized hyperbaric fluid alimentation such as: wall air in hospital setting (I); hyperbaric bottles (III); or atmospheric air reservoir (III), which could be filled manually and/or with compressor. The fluid may be air or liquid e.g., seawater in case of drowning. Te generator (G), could be connected directly to its source with high pressure flexible hose equipped with unidirectional monovalve. The generator (G), is functionally alternating pulsation between T1 & T2, staring by T1, at fixed frequency around 40 bpm. The generator is equipped with sensors to capture and detecting spontaneous return of heartbeat. Then once heartbeat returned back, frequency of T2 must be reduce to 20 bpm, and the device will be used as a respiratory assist as well as cardiopulmonary resuscitator device. The T1 frequency must be kept around 40 bpm. The induced pressure is variant and in correspondence to ages and body surface area. The mean purpose is to move the stagnant infradiaphragmatic blood usually in the splanchninc and lower limbs regions. In the thoracic compartment, pressure must be applied in a matter to allow rhythmic recoiling of the chest wall in horizontal axis. These need a low-pressure application, approximately (0.8-2 bars). Security features are provided, particularly highpressure spontaneous releasing valves to avoid over inflation in case of mechanical pump failure.

Figure 9:
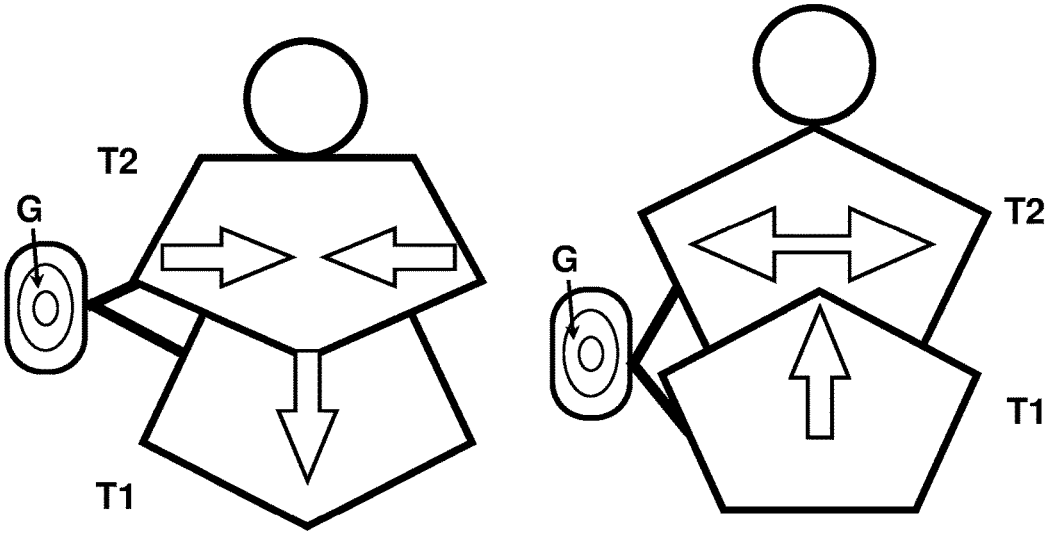

FIG. 9 represents the mechanism of the CFR device according to one embodiment of the present invention. The right panel (A) shows: Vertical arrow, representing the abdominal systole triggered by (T1) alternating with thoracic diastole triggered by T2 (horizontal arrow). Conversely, the left panel (B) shows: the thoracic systole triggered by T2 (horizontal arrow), is alternating with the abdominal diastole triggered by T1 (vertical arrow). G=generator.

Figure 10:
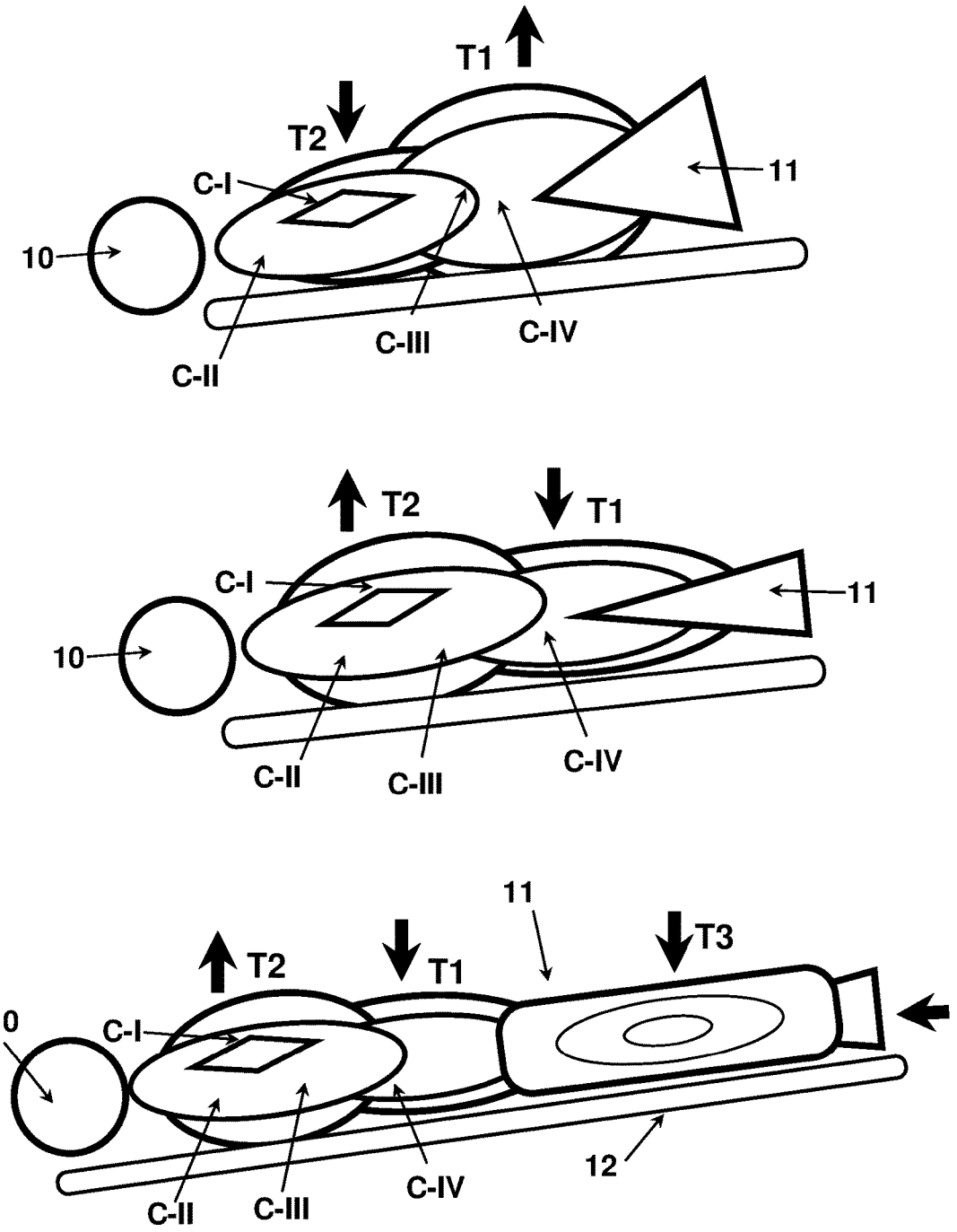

FIG. 10 is a profile schema representing the mechanism of a CFR device according to one embodiment of the present invention. The upper panel (A) shows a lateral profile of a presumed SCA victim during a thoracic systole (T2), and abdominal diastole (T1). The middle panel (B) shows a lateral profile of a presumed SCA victim during the thoracic diastole (T2), and abdominal systole (T1). The lower panel (C) shows the Full Throttle CFR-Gear, showing a schema of a presumed patient's profile on a trolley board, in a Trendelenburg Position: head down (10) and limbs up (11). A full CFR gear is wrapped and positioned around the patient's chest (T2), trunk (T1) and lower limbs (T3). C-1=the mediastinal shearing mass; C-2=Pulmonary pump, C-3=the diaphragmatic pump; C-4=the infradiaphragmatic shearing mass.

Figure 11:
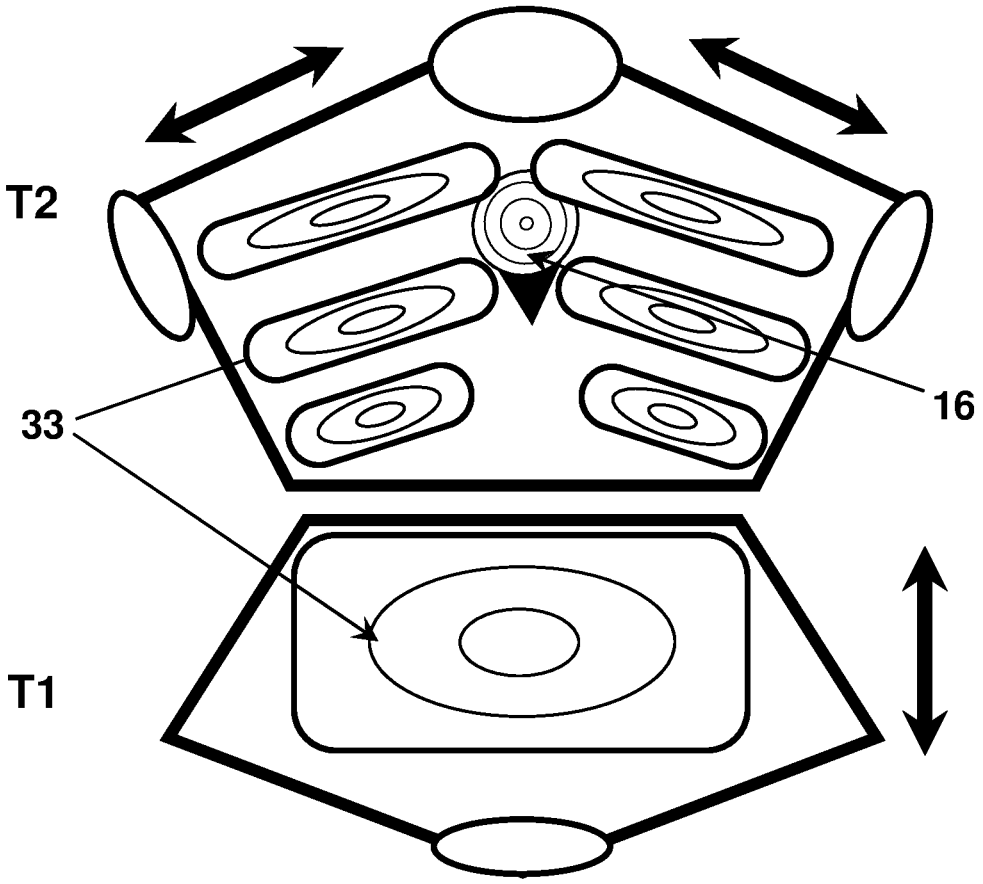

FIG. 11 shows the principles of a simplified CFR device according to one embodiment of the present invention comprising two layers, an outer shell and inner inflatable/ deflatable straps and/or bladder (33). "La Mallette" simplified embodiment, suitable for newborn and overweight victims, showing the CFR device (La Mallette) composed of reinforced inflatable/deflatable straps and/or bladder (33). This may take the anatomical shape of thoracic cage at (T2), this means straps should be arranged in horizontal axes in newborns and pediatrics and oblique axes in adults. At (T1) the device could be simplified by an inflatable/deflatable abdominal bladder in (33).

Figure 12:
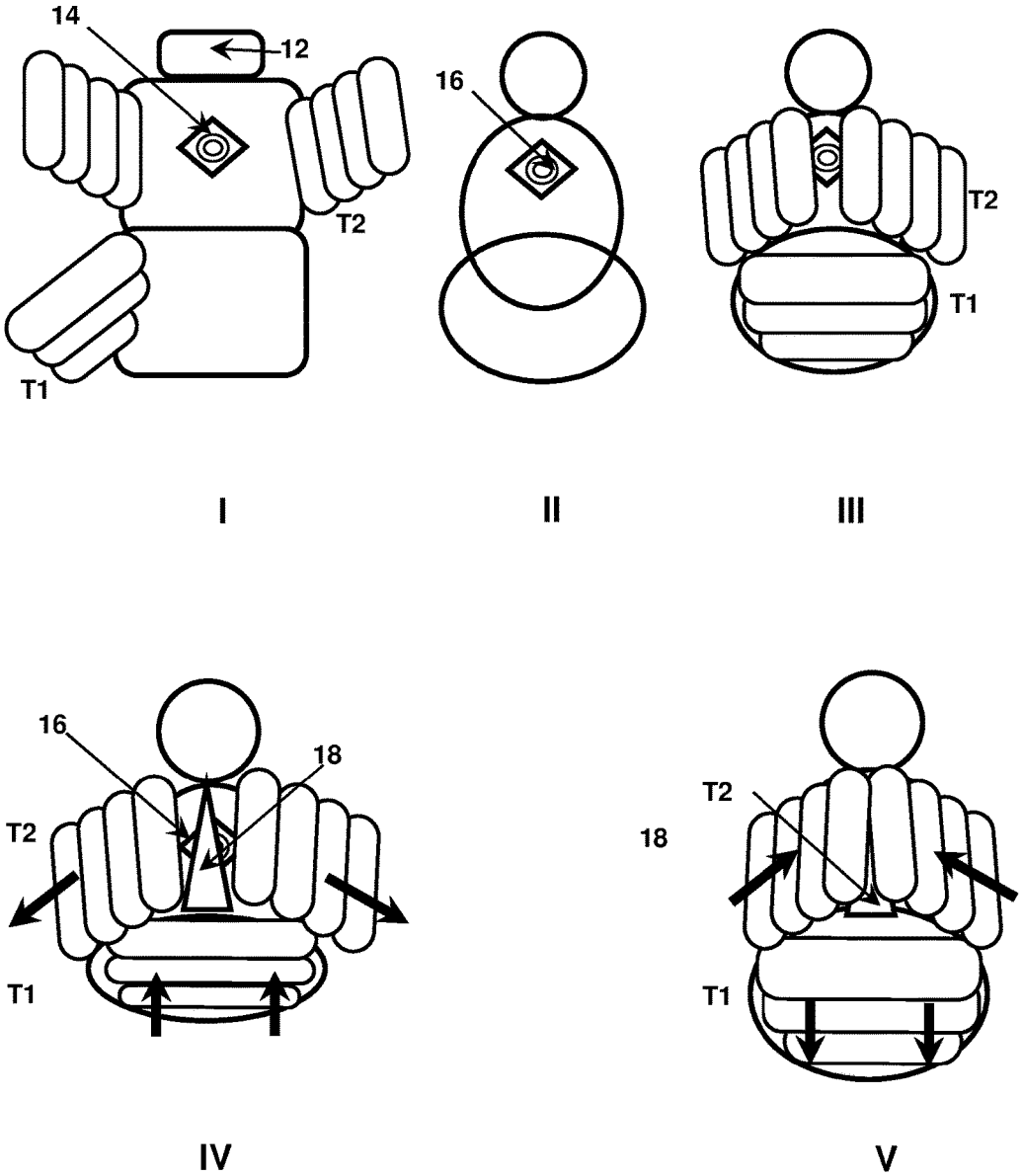

FIG. 12 shows another embodiment of the present invention. La Mallette: a full Throttle-CFR device.

FIG. 13 represents another embodiment of the present invention: 34, 35=modifiable articulated bars; 36=longitudinal bars; 37=infradiaphragmatic piece; 38=alternating generator. The violet arrows show the requested axis of bars movements. FIGS. 13 I & II represent the infradiaphragmatic piece movements during cardiac arrest (following T1); and FIGS. 13 III & IV represent the infradiaphragmatic piece movements once a heartbeat is detected.

"Practy" is a thoracic pump assist device, which could be a practical masterpiece of "La Mallette" as CFR device, as well as a concept of new generation of noninvasive mechanical ventilation. It consist of modifiable articulated bars (34, 35) that can be moved (Froth and Back) within the respect of thoracic cage physiological movement. As a symbolic, but unlimited example, the external lateral bars moving on, which could be achieved. It should be emphasized that articulated bars system, could be easily mounted and changed according to patient's size. These are previewed with chains of longitudinal bars (36), and more interestingly the whole "Practy" system could be integrated into a suitcase like system, and to be rearranged to fit patient's chest tightly.

The violet arrows show the requested axis of bars movements. According to the Somarheology" theory the "Practy" system involves already 3 covering external shear stress-mediated endothelial function driving forces: C-I (mediastinum); C-II (pulmonary pump), C-III: (diaphragm).

The Infradiaphragmatic piece (37), is representing the diaphragm muscle, meanwhile in case of SAC, victims this will follow the T1 systole and diastole as the main target is to move stagnant blood. Otherwise, after return of spontaneous circulation or assisting with mechanical ventilation the diaphragmatic belt will follow the normal respiratory function, to allow inspiration and expirations.

As one of the advantage of "La Mallette", in case of chest trauma (e.g., compound rib fracture, vertebral column fracture, etc.), which makes application of T2 is hazardous, the CFR T1 will be the most effective piece as a pre-hospital CPR therapeutic approach; until to be associated with invasive respiratory assist devices (e.g. mechanical ventilation, and most preferably extracorporeal membrane oxygenation (ECMO). Visa versa, the abdominal piece (T1), is contraindicated in case of abdominal trauma.

Figure 14:
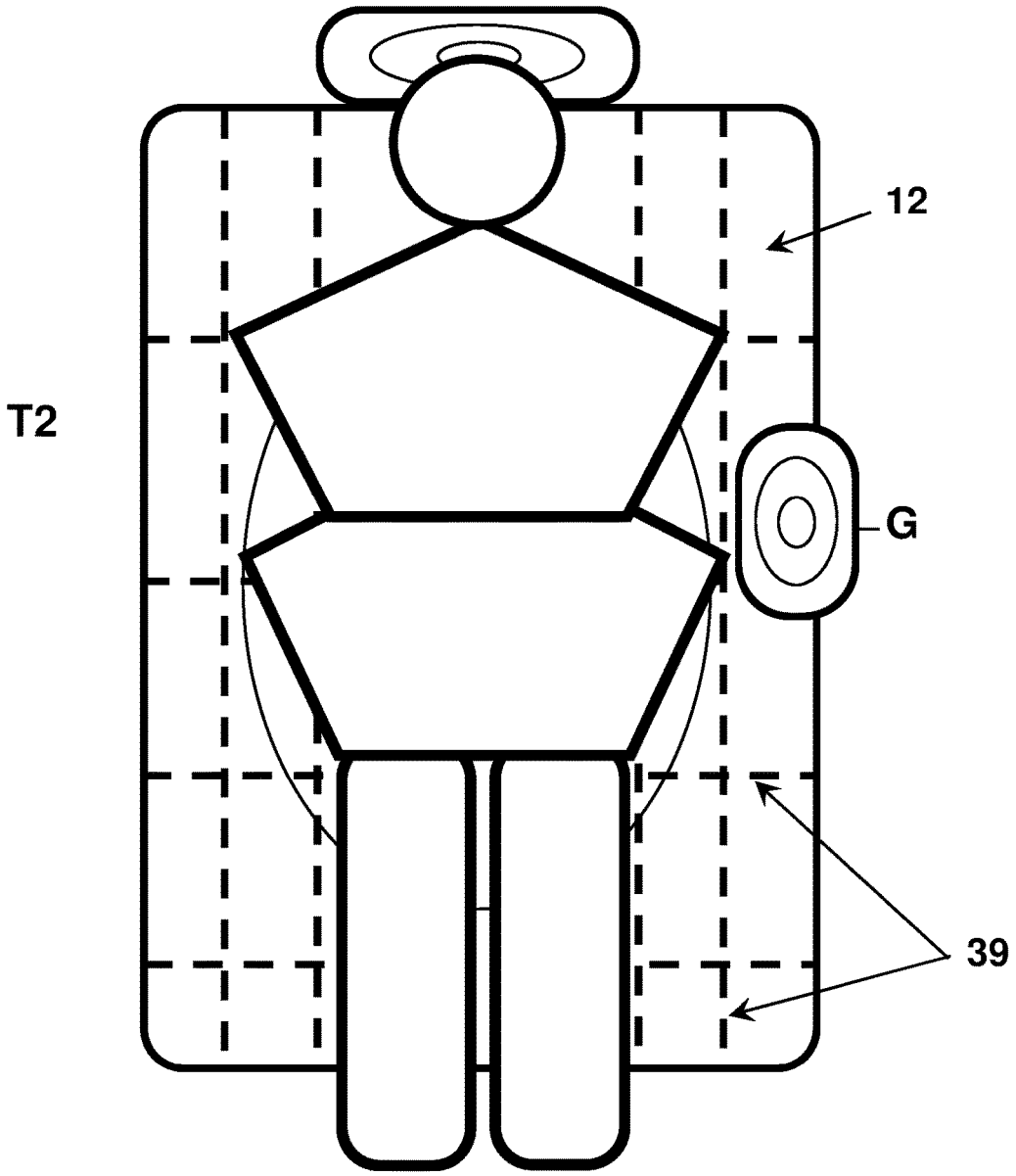

FIG. 14. "La Mallette" suitcase like system transformed into an emergency trolley (12) showing: horizontal and longitudinal intersectional divisions lines (39). In purpose to resolve sizing problems, the victims will be positioned between those lines, and then the device trapdoors (T1, T2) will be shut in corresponding to body size.

DETAILED DESCRIPTION OF THE INVENTION

A multicellular organism, like a human being, depends on the distribution of circulatory fluids' for exchange of substrates. These principles of substrate diffusion through the cellular membrane depend on fluid dynamic forces (e.g. blood, air, synovial fluid, CSF, etc.). This process that usually occurs and starts through conductance and gradients at the cell membranous barrier, normally occurs through three mechanisms: a) mechanical (e.g. shear stress); b) chemical (e.g. electrolytes channels); and c) electric (e.g. electrophoresis) mechanisms.

Figure 1:
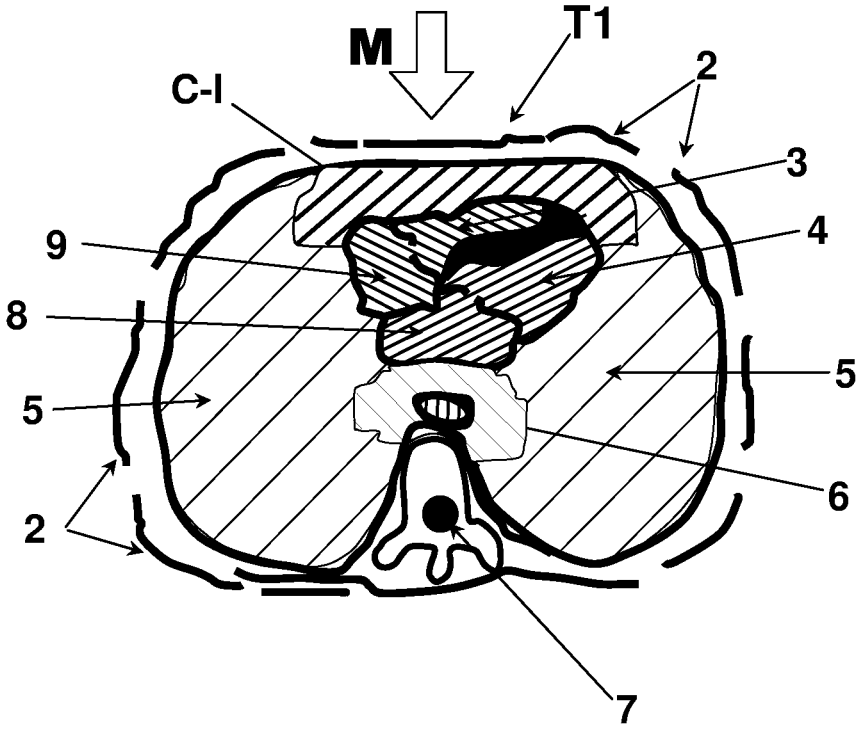
FIG. 1 represents a schema of a cross section of a human thoracic CT scans at the midsternal level: C-I=Retrosternal mediastinal covering zone; M=a symbolic midsternal compression force; 1=sternum; 2=chest wall; 3=right ventricle (RV); 4=left ventricle (LV); 5=lung; 6=Aorta (Ao); 7=dorsal vertebra; 8=left atrium (LA); 9=right atrium (RA).
Figure 2:
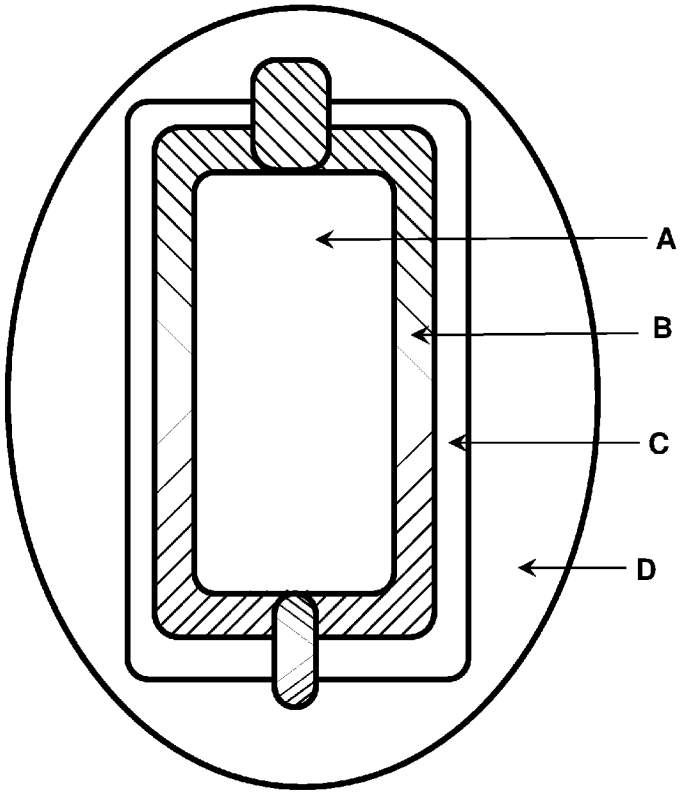
FIG. 2 shows therapeutic principles of the "Somarheology" hemodynamic theory: A=fluid's sphere; B=cellular barriers sphere; C=covering tissues sphere; D=present device territory.
Figure 3:
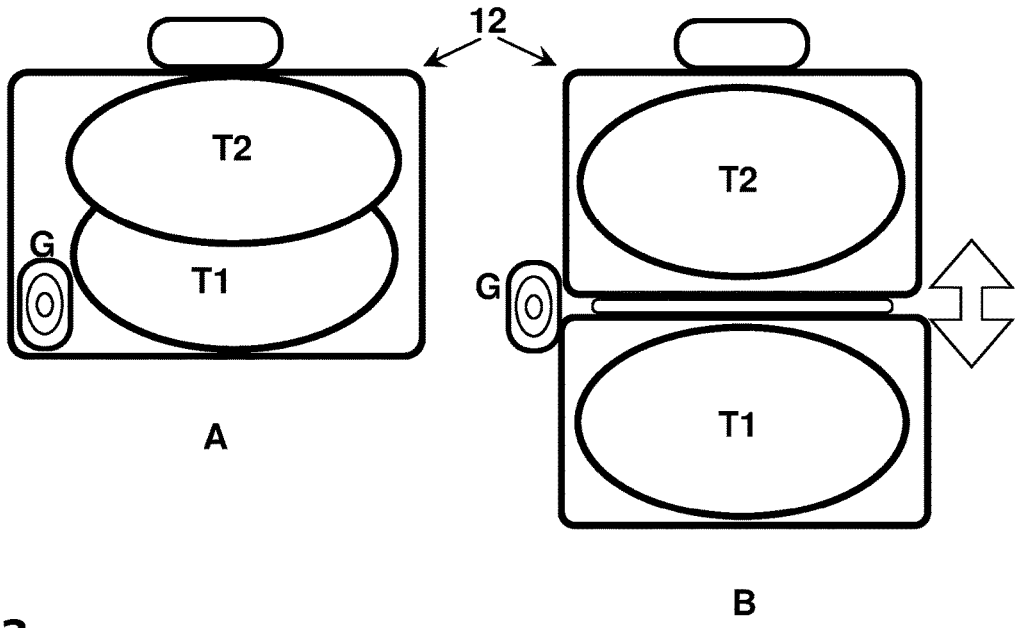
FIG. 3 shows one embodiment of the present invention represented by a briefcase design. A) Device prior to deployment; b) a deployed device, transformed into an emergency board trolley. The CPR briefcase (La Mallette), contains: a CPR Gear composed of abdominal compartment (T1); thoracic compartment (T2); a pulsatile generator. Right panel represents a deployed device, transformed into an emergency board trolley.
Figure 4:
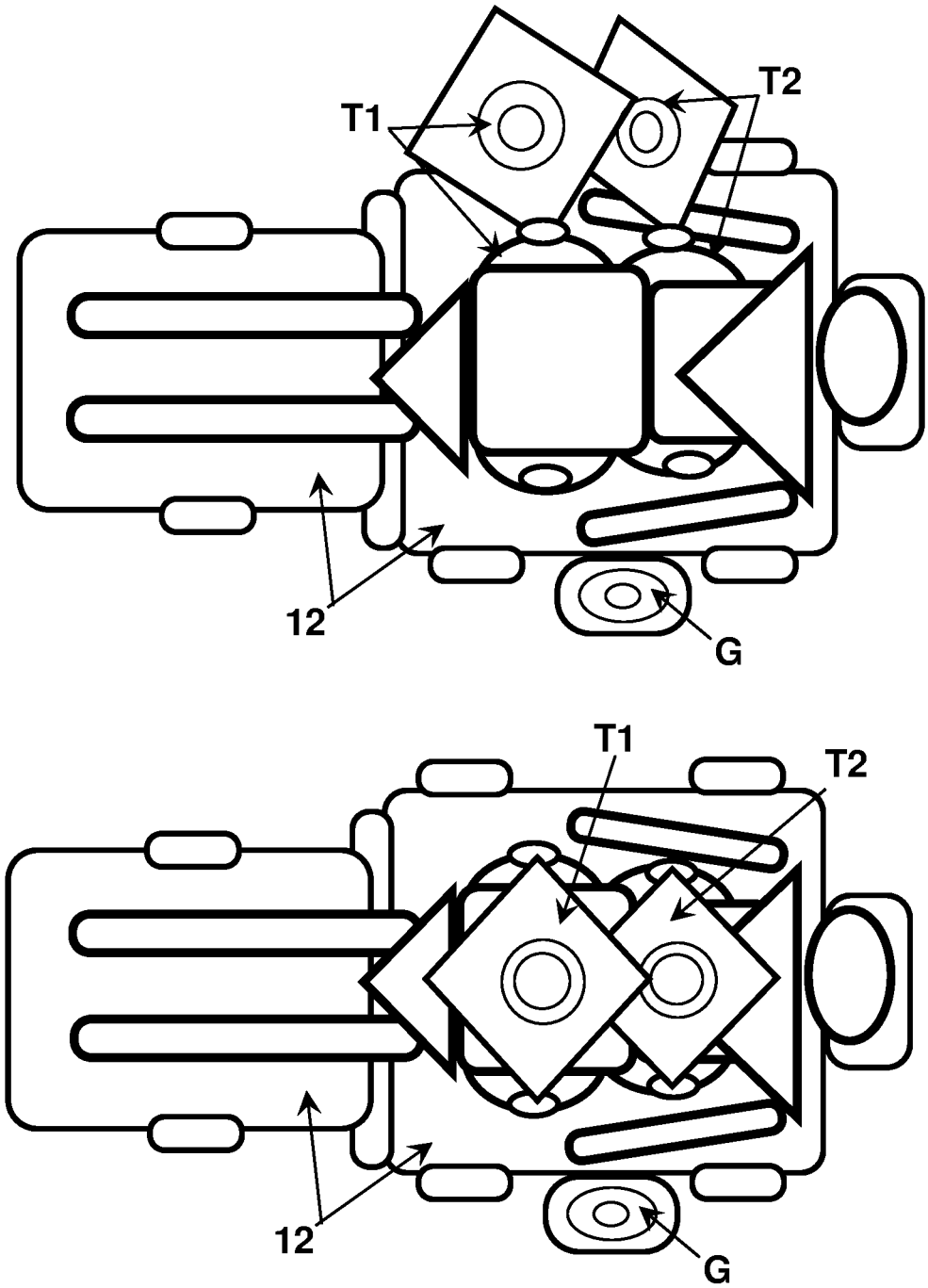
FIG. 4 shows an embodiment of the invention wrapped around a presumed SCA victim. "La Mallette" wrapped around a SCA victim as a CFR device. Depicted are schemas of a SCA victim, positioned on a deployed CPR briefcase "La Mallette", showing: abdominal compartment (T1); thoracic compartment (T2); a pulsatile generator; and a transformed Set Bagemergency board trolley (12). (A) T1 and T2 positioned adjacent to the SCA victim. (B) T1 and T2 positioned in front and/or behind the SCA victim.
Figure 5:
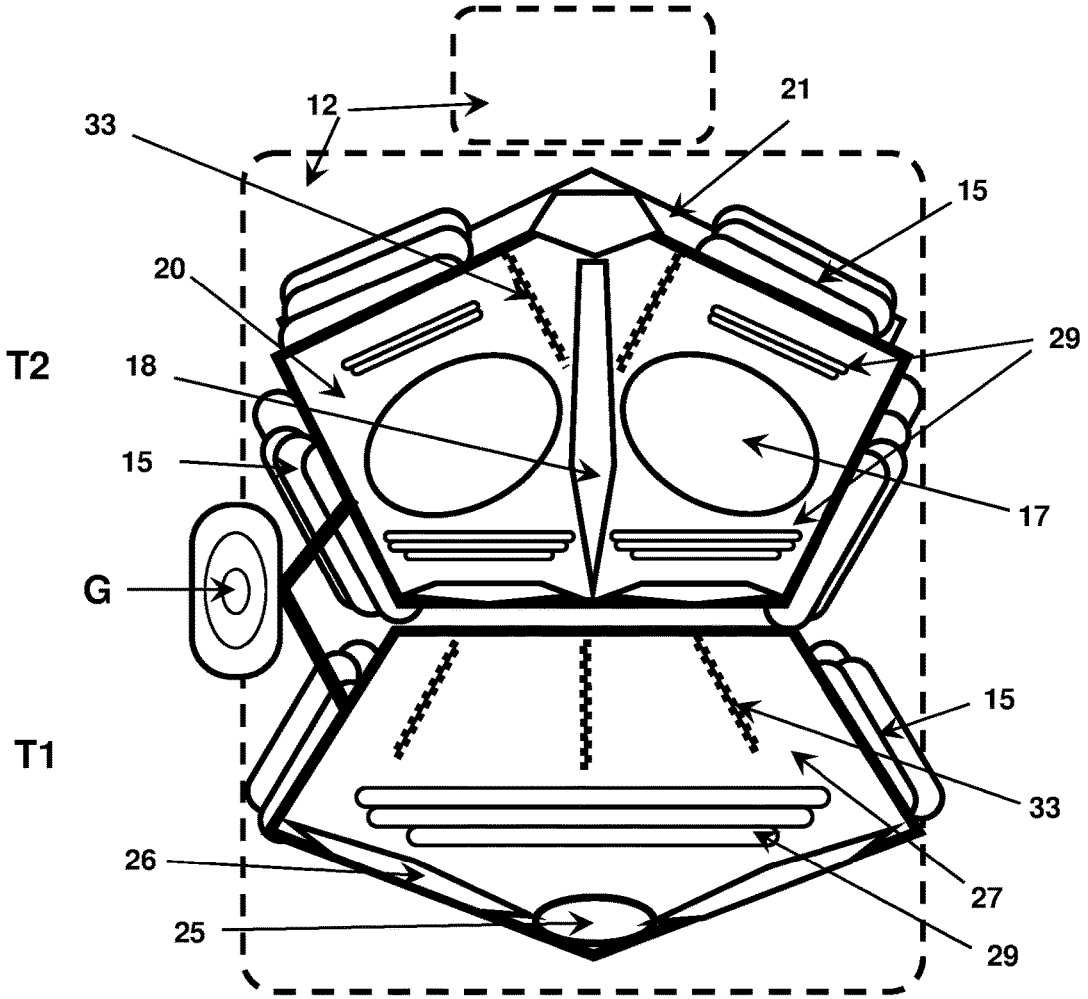
FIG. 5 is a front view of an embodiment of the present invention showing the abdominal (T1) and thoracic (T2) pressure elements; 12=deployed trolley; 15=intersection adjustable pads; 17=mammary groove-pads; 18=sternal protector pad; 20=external shell of (T2); 27=external shell of (T1); 25;26=Genital and Groin grooves, respectively; 29=plied-extensible pressure elements for length adjustments; 33=Zippers for width adjustments. "La Mallette" frontal view: a deployed trolley (12); Intersection adjustable pads (15); mammary groove-pads (17); sternal shaft (18); External shell of the thoracic "T2" (20) and infradiaphragmatic "T1" (27) compartments respectively; Genital (25)

The present invention is based on the idea that also the blood circulatory system which represents a closed hydraulic pressurized circuit lined interiorly with endothelium, could also be subdivided into three spheres: sphere (A), containing blood that shears an overlapping sphere (B), which is composed of barriers of endothelial cells, covered and squeezed externally with surrounding tissues sphere (C). In FIG. 2 a schematic division of the human body into three rheological spheres (A, B and C) is shown, wherein A stands for the amount of fluids, that could be compressible Newtonian (e.g. air), or incompressible non-Newtonian (e.g. blood) fluids, surrounded by B, the barriers of cells (e.g. endothelium), overlapped by C, the covering tissues (e.g. peristaltic vessels, expandable alveoli, etc.).

In the same manner, the respiratory pump, which we have recognized previously as the Maestro of the Circulatory system, could be subdivided according to the present concept of the somarheology theory into three spheres as well: Sphere (A) that correlates with fluids (air or blood), separated by sphere (B) composed of barriers of the capillary or alveolar endothelium, followed by sphere (C), which is composed of covering tissues' layers representing the other components of the thoracic cage (e.g., pulmonary parenchyma, peristaltic vessels, intercostal muscles, diaphragmatic pump, etc.).

Current CPR methods focus on the heart trying to restore heartbeats as a first priority. This technique ensues that the compressed intracardiac blood will be transferred backward into the valveless vena cava system and forwarded towards the pulmonary artery. In fact systemic veins are less compliant than the pulmonary artery, which means the few amount of blood will never travel further than the pulmonary artery.

In contrast thereto the present invention focuses on the stagnant blood, stocked inside their corresponding endothelial containers. During clinical practice it has been found that when squeezing directly the left ventricle of the heart, pacemaker cells are directly affected in a more advantageous non invasive manner, with tissues perfusion being restored/maintained to an extent that severe brain damages could essentially be avoided. Table I below summarized some of the findings leading to the present invention.

TABLE I

| Victims | Pathologies | CPR | CA | Cerebral sequels | Recovery |
|---|---|---|---|---|---|
| 74 ys old (F) | Rupture aortic arch | Open + CPB | ≥30 min | Severe "CT scan" | Total |
| 31 ys old (F) | Rupture posterior LV wall | Open + CPB | ≥30 min | Severe "CT scan" | Total |
| Newborn (3 h) | Severe Congenital Ao Stenosis | Open + CPB | ≥30 min | Severe "CT scan + EEG)" | Total |

(F) = Female; CPB = cardiopulmonary bypass; LV = left ventricle; EEG = electroencephalogram; CA = cardiac arrest; CPR = cardiopulmonary resuscitation Without wishing to be bound by any theory it is presently contemplated that compressions on the stagnant RA & RV blood (right ventricle (RV) and right atrium (RV) will induce a movement of the blood in the circulatory system, which movement creates a shear stress-mediated endothelial function inside the RV subendocardial endothelium system, which is very sensitive to endothelial mediators that will improve blood flow through the interseptal coronary network, and myocardial microcirculation. Hence, according to the present invention shear stress-mediated endothelial function has been found to represent the cornerstone that will improve myocardial perfusion and a return of normal heartbeat.

The medical device according to the present invention comprises at least two pressure elements (T1, T2), at least one to be arranged in the region of the abdomen/hip/trunk of the patient (T1; infradiaphragmatic element) and at least one to be arranged at the region of the patient's chest (T2).

Pressure element (T1) is to be arranged such that there will be an essentially close contact with the patient's body, which may be achieved by wrapping and/or fixing the element (T1) at the patients body, e.g. by means of straps or zipper systems, hook and loop fastener etc. Optionally a close contact may be achieved and/or improved by providing entities in said at least one pressure element (T1), that may be filled or are already prefilled with a soft or resilient material, such as a foam or a fluid, such as air, gel or any other liquid, so as to improve contact with the patient according to its body contours.

The abdominal pressure element (T1) may have any suitable form, preferably a layered form to be contacted with to the patient's body, e.g. the form of round, square or triangular layer, or specially layered forms, such as a belt, a trouser, or a diaper or any other form, as long as a close contact with the patient's body may be ensured. The form of a trouser of diaper has the additional advantage in that venous blood in the calf and feet capillary system, that has blood oxygen saturations close to arterial blood will be pumped pressed to the upper part of the body rapidly, which creates a physiological backup for tissues oxygenations in SCA victims.

The abdominal pressure element (T1) is sized such that it essentially covers the patient's epigastric area from side to side, optionally including upper parts of the tighs and ending a the patient's thorax area, where pressure element (T2) is to be arranged.

The present medical device also comprises at least one thoracic pressure element (T2), which is adapted to be arranged at the region of the patient's chest. As for pressure element (T1) also the arrangement of pressure element (T2) is such that there will be an essentially close contact between pressure element (T2) and the patient's body, e.g. achieved by wrapping and/or fixing the device, e.g. by means of straps or zipper systems, hook and loop fastener etc. Optionally, as for pressure element (T1), additional entities may be provided in the said element (T2) to be filled with fluid, such as air, gel or any other liquid, or being already prefilled with such fluid, or containing another soft and essentially resilient material, such as a foam, to improve contact of the element with the patient's body. The thoracic pressure element (T2) may have any suitable form, preferably a layered form to be contacted with to the patient's body, e.g. the form of round, square or triangular layer, or specially layered forms, such as a belt, a shirt, or a vest or any other form, as long as a close contact with the patient's body may be ensured.

The thoracic pressure element T2 is sized such that it essentially covers the patient's chest area from side to side and ends at its lower end of the thoracic cage, where pressure element (T1) starts to be arranged, and at the upper end at the maipural sternal groove. In addition, the contact of the pressure element (T2) with the patient's body at/around the chest should be without any restriction neither for chest recoil nor the respiratory movement in case of spontaneous return of the circulation.

As will be appreciated, both of the at least one pressure elements (T1) and (T2) have a length and width, so as to cover the body's area, on which pressure shall be exerted. Also, both of the pressure elements (T1, T2) may be made of a flexible material, allowing transfer and optionally also the creation of pressure to be exerted on the human body.

Each of the at least one pressure element (T1, T2) comprises at least one pressure exerting unit, capable of exerting pressure in the direction of the patient's body, which unit may be attached to the respective element (T1, T2) or embodied therein, or may be represented by the said elements (T1, T2) itself.

There may be one, two, three, four, five, six, seven, eight, nine, ten or more of such units, which may be provided in the elements arranged one after the other (in the direction of the height/length of the patient's body) and/or may be arranged adjacent (relative to the width of the patient's body). The pressure units may be arranged essentially perpendicular to the patient's length axis or essentially in line with the patient's length axis, or bevelled in any angle thereto.

The pressure exerting unit itself may be embodied as a roll or a compactor or may have the form of a bag, pouch or a pad in an essentially triangular, square or elongated form or may be any combination thereof.

According to an embodiment the pressure exerting unit comprises or is represented by at least one bag, pouch or pad. The bag, pouch or pad may have furthermore any form as described above for the elements (T1, T2), respectively.

The at least one bag, pouch or pad may be prefilled with a particular material, preferably a resilient material, such as foams, a gelatinous fluid and/or other similar materials so that pressure exerted thereon, e.g. by a roll or a compactor, is dissipated to some extent prior to its transfer to patient's body.

Alternatively the at least one bag, pouch or pad is formed such that its dimensions may be varied by filling/discharging a fluid into/out of the said bag, pouch or pad, e.g. inflating and deflating the same with a gas, preferably air, or by filling/discharging a liquid, such as a liquid, preferably a gelatinous liquid. In this embodiment filling the bag, pouch or pad with the fluid will enlarge its dimension, which enlarged dimension will exert a pressure on the patient's body at the respective location.

According to another embodiment in the respective elements (T1, T2), at least two bags/pouches/pads, preferably three or four of five or six bags/pouches are arranged adjacent to each other (relative to the width of the patient's body) and at least two bags/pouches/pads, preferably at least three, four, five or six bags/pouches/pads are arranged one after the other (relative to the height/length of the patient).

The present invention also envisages the provision of two, three, four or more bags/pouches/pads on top of each other so that the pressure exerted by each bag/pouch/pad will add.

The bags/pouches/pads may be filled with fluid separately. Alternatively, at least two, e.g. three, four or more bags/pouches/pads may be in fluid communication, so that upon filling one bag, which expands and creates a pressure on the patients body, the next bag is filled after the upstream bag/pouch/pad has been filled to a certain, predetermined extent. This may be achieved e.g. by providing a communication between the bags/pouches/pads, which is e.g. limited in diameter or harbors a valve.

According to another embodiment the pressure elements (T1) and (T2) may also be formed as a multilayer structure, wherein at least one layer comprising the compressing/decompressing units is arranged adjacent to at least one inner layer, facing the patient and at least one outer layer facing the environment. The multilayer structure may thus comprise two, three, four, five and even more layers, with a varying number of inner layers, outer layers and intermediate layers (comprising the at least one pressure exerting unit).

The external layer may be formed of any suitable material, which essentially provides maintenance of the physical form of the pressure elements (T1) and (T2) to the surrounding, e.g. of a of a rigid, preferably lightweight material.

The inner layer facing the body should preferably be made of a flexible biocompatible material, which allows transfer of the pressure to be exerted on the human body through the layer.

The intermediate layer formed as described above for the elements (T1, T2) may be present as one layer, as two layers as three layer or even as four layers, stacked on top of each other either directly on to of each other or offset to a certain extent etc. An offset arrangement of e.g. two layers stacked on to of each other will allow provision of a moderate pressure waveform in the elements (T1, T2) during operation.

In general, the chosen materials and design must allow attachment and/or wrapping of the device around the SCA victims body tightly and smoothly, particularly, the abdominal part.

It will be appreciated that the pressure exerting unit may be the same or different in any of the pressure elements (T1) and (T2). Yet, in view of the morphological bony character of the thoracic cage inflatable/deflatable bags/pouches/pads that will be in direct contact with the body are considered to be practical for pressure element (T2).

The present device may contain one of each pressure elements (T1) and (T2) or may contain two of each pressure elements (T1) and (T2), to be arranged in front of (anterior pressure elements) and also behind (posterior pressure elements) the patient's body.

Both of the pressure elements (T1) and (T2) and the at least on pulse generator may be suitably arranged on and optionally fixed to a support, which support may be made of a rigid or flexible material and which support may then be affixed together with the pressure elements (T1, T2) to the patient by suitable means, with the pressure elements (T1) and (T2) facing the patient. For the ease of transport, storage and handling the support may have the form of a bag or container, which may be closed, e.g. like a briefcase, and which has an inner front side and an inner back side. The at least two pressure elements (T1) and (T2) may be attached to the inner front side and optionally also to the inner back side of the support, and may be arranged during storage an transport in close proximity or even overlapping, so as to reduce the size of the bag or container. In a closed position of the bag/container the inner back side faces the inner front side, so that all of the pressure elements (T1) and (T2) are within the bag/container and protected against environmental influences. Upon opening the bag/container the two pressure elements (T1) and (T2) will be positioned in an opened, preferably flat arrangement and may be pulled apart from each other to a desired length/width so as to adapt to the different contours of human bodies. To this end the support may either exhibit means to increase the dimensions of the support itself, such as pliable areas or zippers, so that upon increasing the dimensions of the support also the pressure elements (T1, T2) will be spaced more apart, or the support may provide guiding means for moving the pressure elements (T1) and (T2) in a predetermined direction. The support and/or the bag will preferably also harbor the pulse generator with all the cables and tubes being affixed to the support. The outer sides of the support (bag/container) will preferably be rigid enough to protect the interior, i.e. the pressure elements, the pulse generator and the cables tubings etc. from external influence, that might damage the system.

The device may also be equipped with securities features in particular auto-release pressure valves as been described in patents WO/2008/000111 and WO 2010/070018, the contents of which is herein incorporated by way of reference.

According to an embodiment the present device, in particular the pressure element (T2), may be provided with mammary protector pads (15) arranged at the device in a detachable fashion thereto. Such means allows full integration of the chest pressure element (T2) to the chest wall without any traumatic risk (e.g. mammary hematoma). Folded extensions pressure elements and zippers may be integrated in the external shell or length and width adjustments, respectively.

According to another embodiment the present device may also be provided in addition to underneath tissues protections with the genital & groin grooves, which allow provision and handling of standard life-support medical instrumentation, e.g., urinary catheter, rectal probe, femoral arterial or venous lines.

According to yet another embodiment the present device may also be provided with a defibrillator, arranged such that upon fixing pressure element (T2) the defibrillator is at the right position already.

The device may also be equipped with a non-invasive central venous pressure monitor: to measure approximately during cardiac arrest: the Mean cardiovascular pressure which is normally between 15 & 18 Cm water and controlling the RA filling pressure, which should not exceed >16 mmHg. And after ROSC, venous pressure, CO and $SVO_2$.

The present device may be operated as follows.

In case of being embodied on a support the bag or container is opened, the SCA victim will be correctly positioned and the pressure elements (T1, T2) will be attached to the patient's chest and trunk. Optionally, both of the abdominal pressure element (T1) and the thoracic pressure element (T2) may then be inflated till they become less loose around the patient's body.

The abdominal pressure element (T1) may then be switched on at a frequency of e.g. 30-50 bpm, preferably around 40 bpm. The thoracic pressure element (T2) is then also switched on in same, however alternating frequency with (T1).

In case both of the pressure elements (T1) and (T2) comprise more than one compressing/decompressing unit, e.g. two three or four, the said units may be initiated to exert a waveform pressure in a particular direction. In this respect the compressing/decompressing unit in pressure element (T1) is initiated first to exert pressure, which is located at the lower end of element (T1), i.e. at the end of the patient's body distal to the head. Then, while the pressure in the first compressing/decompressing unit is initiated to cease, the pressure in the compressing/decompressing unit in pressure element (T1) adjacent and more proximal to the patient's head is increased and so on. hence, a pressure-wave may be exerted on the patient's body that guides the fluids in the patient's body in a particular direction. The same applies for the compressing/decompressing units in pressure element (T2), wherein the pressure wave created here may be in line with the patient's height or perpendicular thereto or bevelled thereto. As shown in particular in FIG. 12, IV and V, the pressure wave will go up and down (T1) on the patient's body and body sidewards and inwards (T2). It will be appreciated that the pressure waves in (T1) and (T2) will be alternating as mentioned above.

The therapist may position the patient in a Trendelenburg's position (head down and limbs up).

As soon as the therapist observes vitals signs and once heartbeat is detected the (T2)/(T1) frequency will be switched to one-on-two, in a matter to cope with the respiratory movements.

In addition DC shocks may be applied as auxiliary means after the device has been installed and is fully functioning for several minutes.

According to an embodiment the device may be operated in form of a "Wormy" system, which is composed of several units. Each unit as shown in (FIG. 7-I) is prefilled with compressible fluid that could be plied in a helical coil form allowing its spreading on/off rapidly. These could be achieved with two rolls/balls made of semi-rigid and extensible materials, located at each extremities, unequally prefilled with fluid, and kept in a helical form (30 & 31). The "Wormy" units could be located and sandwiched in the intermediate chamber composing a space between the outer shell and the inner layer. The main function of the intermediate chamber is transmitting the pressurized impacts triggered by the corresponding generator inward into the inner layer, in respecting the requested axis and direction of flow. Thus, the "Wormy" system will be connected to a rhythmic pneumatic and/or an electro-mechanic generator (G). The "Wormy" unit could be compressed directly as well by the external shell compressing electronic plate inducing wave-like impulses. Once the generator switched on, compressing a ball at one end, it will be transferred in a growing compressing wave into the other end. These will compress the underneath pads (32) located in the inner layers within the requested axis and function. For example, in the chest vest (T2), the requested axis must be horizontal, which is corresponding to the physiological thoracic pump axis, to squeeze the thoracic cage (C-II), inducing controlled rhythmic contracting (upper panel, II) and decontracting (lower panel, III) movements. Accordingly, the "T2" could be considered as a new concept of non-invasive mechanical respiratory assist device, as well. Meanwhile, the axis in the infradiaphragmatic pressure element (T1), direction should be vertical in the direction of venous return.

One of the major advantages of the "Wormy" system that it could control a rapid and/or slowing "forth and backward" movement. For example, to create a snapping effect upon the inner underneath layers and SCA victim's body, e.g. increasing the time of compressing cycle and shortening that of decompressing. It resembles in some sort a reversed cardiac cycle (the presumed device systole of (T1), will be longer than the diastole. These major advantage will open the door for several embodiments of the invention with several indications and applications for healthcare in alive persons.

The generator (G), is functionally alternating pulsation between T1 & T2, staring with T1, at fixed frequency of e.g. around 40 bpm. The generator is equipped with sensors to capture and detect a spontaneous return of heartbeat. Once return of heartbeat has been detected, the frequency of T2 is reduced to 20 bpm, and the device will be used as a respiratory assist as well as cardiopulmonary resuscitator device. The T1 frequency must be kept at around 40 bpm. The induced pressure is variant and in correspondence to ages and body surface area. The mean purpose is to move the stagnant infradiaphragmatic blood usually in the splanchninc and lower limbs regions. In the thoracic pressure element, pressure must be applied in a matter to allow rhythmic recoiling of the chest wall in horizontal axis.

Security features may be provided, particularly high-pressure spontaneous releasing valves to avoid over inflation in case of mechanical pump failure. These are based on our experiences with pulsatile suit in animal as well as clinical volunteers.

In principle there will be an alternating squeezing movement of (T1) and (T2) always started by (T1). Accordingly, and in a matter to adapt with different body sizes (e.g., newborns, paediatrics, adults from both sexes), the "Wormy" system could be embodied by two rolls or balls, helical, hourglass, spiral . . . etc., within the respect of guided and rapid transfer of growing compressed wave forth and back according to the requested axis, i.e., horizontally oblique on the chest and vertical on the trunk and infradiaphragmatic regions. Wormy will compress the underlying structures e.g. prefilled fluid pads inward toward the patient's body.

It consists of modifiable articulated bars (34, 35) that could be moved (Forth and Back) within the respect of thoracic cage physiological movement. As a symbolic, but unlimited example, the external lateral longitudinal bars (36) could command mechanically the attached bars allowing a rhythmic (on-off) grasping movement of the chest wall. It should be emphasized that the articulated bars and infradiaphragmatic piece (37) could have different sizes to be easily mounted and changed according to patient's size. And more interestingly the whole "Practy" system could be integrated into a suitcase like system, and to be rearranged to fit patient's chest tightly. According to the Somarheology" theory the "Practy" system involves already 3 covering external shear stress-mediated endothelial function driving forces: C-I (mediastinum); C-II (pulmonary pump), C-III: (diaphragm). The Infradiaphragmatic piece, is representing the diaphragm muscle, meanwhile in case of SCA, victims this will follow the infradiaphragmatic pressure element (T1) systole and diastole as the main target is to move stagnant blood. Otherwise, after return of spontaneous circulation or assisting with mechanical ventilation the diaphragmatic belt will follow the normal respiratory function, to allow inspiration and expirations. N.B As one of the advantage of "The present device", in case of chest trauma (e.g., compound rib fracture, vertebral column fracture, etc.), which makes application of T2 is hazardous, the CFR T1 will be the most effective piece as a pre-hospital CPR therapeutic approach; until to be associated with invasive respiratory assist devices (e.g. mechanical ventilation, and most preferably extracorporeal membrane oxygenation (ECMO). Vise versa, the abdominal piece (T1), is contraindicated in case of abdominal trauma. Alternating movements between vest bars and infradiaphragmatic belt could be commanded by a specific generator.

Based on clinical observations with the present device it could be shown that cerebral damage situations caused by standard CPR, procedures that was focusing on the heart, may be reduced or avoided.

The present device has been found to provide the following advantages over the prior art techniques, in particular CPR:

1.1. Cardiovascular physiology: "The present device" as a circulatory flow restorator (CFR), will increase the right atrium preload in a rhythmic manner creating a direct snapping effect as well as wall stress stretching to enhance the chances of pacemaker cells repolarization/depolarization, directly by increased shear stress-mediated endothelial function, and indirectly by improving global microcirculations and cellular metabolic process of cardiomycoytes.

1.2. Cardiovascular anatomy: The present device is adapting perfectly and reacting safely on patient's body. According to the "Somarheology theory" the present CFR device, will react on four covering zones (C): C-I mediastinum, C-II thoracic cage and pulmonary pump, C-III diaphragm and C-IV the infradiaphragmatic zone. These will increase shear rates at the Barrier boundaries "B", which will increase endothelial vasodilators mediators, e.g., nitric oxide synthase (NOS), which will improve organs microcirculation and increasing fluid movement from sphere "A".

1.3. Hemodynamic/Hemorheology: According to the hemodynamic theory (Flow and rate), the heart and peristaltic arteries are the main driving forces at the left heart side. At the right heart side, accessory driving forces (i.e., respiratory pump, etc.) play a crucial role in hemodynamic processing. The right heart side contains most of blood volume and endothelial stocks that can be used a physiological backup in case of hemodynamic disorders. During cardiac arrest, exploitations of those precious right heart hemorheological stocks could be perfectly achieved with the proposed CFR device (The present device). These will improve hemodynamic by mobilizing more amounts of blood comparing to present (≈400 ml), and particularly increasing coronary perfusion pressure.

2. Comparison to Prior Arts Devices:

2.1. Compared with CPR devices or the prior art: The present device will provide complete recoil of chest wall, without the common traumatic risk usually factors associated with present devices. The proposed invention device will not be restricted to hospital environments; The present device will be available for applications by bystanders in outdoors environments. It will suitable for pediatrics as well as adults. Under all circumstances that necessitate open chest-invasive CPR, The present device infradiaphragmatic pressure elements could be applied until hospital admitions: e.g. "T1" pressure element as a flow enhancement device in almost of SCA cases except abdominal trauma. A trouser will be safely applied under such condition. In case of cardiac tamponade the whole device could indicated in hospital setting e.g. guided echographic cardiac drainage, IV fluid, etc.

2.2. The present device could be applied safely by bystanders on SCA victims, providing an important good feedback about the method compared with present arts. Regarding animal models, we are planning in vivo studies closer to clinical reality without mechanical respiration, neither pharmacological CPR supports.

2.3. The present device is in particular advantageous in case of certain pathological conditions, such as in case of the denervated heart-transplant patients, wherein the mechanism of cardiac rhythm becomes totally dependant on pressurized blood flow dynamic forces.

3. Pharmacological supports: the present invention as a flow dynamic restorator will enhance the efficiency of IV pharmacological supports compared to the present art. These will reduce the necessity of the hazardous ICI techniques. Furthermore, applications of vasopressors like epinephrine and their side effects will be unnecessary due to the associated endothelial vasodilators secretions.

4. DC Shock drawbacks: The present device, will be equipped with DC shock adhesive patch including part of present technology of AEDs, which could detect heartbeat to avoid unnecessary shock. Instead the advantages of The present device DC shock systems include: the anteroposterior positions of the electrodes that will allow more precise and efficient results compared with transthoracic or anterolateral patches' positions. The proposed invention device per se does not particularly focus on heartbeat as a first priority; instead it will improve cardiomyocytes microcirculations, which will prepare the heart for better defibrillation environment. Because the anteroposterior position DC Shock, requires less energy to reverse VF (ventricular fibrillations), there will be no need for several minutes of massage, strong DC shock enough to affect pacemaker cells that represent ≈1% of cardiac myocytes, with high risk of myocardial necrosis caused by an electroporation, could be safely used in case of digitalis toxicity, which will be washed out with the improved microcirculations. Low risks of thromboembolic accidents, skin burns. In addition to that a zero risk of post DC shock pulmonary edema, due to the application of the thoracic (T2) pressure element, which is considered as a respiratory assist device as well.

5. One of the major advantages of the present invention that will allow the snapping effect (or internal whipping like action on the internal right atrium wall). Which means increasing the time of compressing cycle and shortening that of decompressing. It resembles in some sort a reversed cardiac cycle (the presumed device systole of (T1), will be longer than the diastole.

6. In addition, the expected improvement of organs microcirculation provided with the present invention CFR device will significantly reduce the post-resuscitation mortality rate.

What is claimed is:

1. A medical device for restoring blood circulatory flow in an individual after occurrence of a sudden cardiac arrest, the medical device comprising:

at least one abdominal pressure element, configured to be arranged at or around a patient's trunk and comprising a plurality of units capable of exerting pressure on a patient's body;

at least one thoracic pressure element, configured to be placed at or around a patient's thorax and comprising a plurality of units capable of exerting pressure on the patient's body; and at least one pulsatile generator in electrical and/or fluid communication with the at least one abdominal pressure element and the at least one thoracic pressure element, wherein each pressure element comprises a plurality of pressure units, each pressure unit comprising one inner layer configured to face the patient, one outer layer configured to face the environment, and an intermediate layer comprising a plurality of pads facing the inner layer and two balls spaced apart from each other and located between the outer layer and the pads, the two balls being configured to be alternatingly filled and purged with a fluid respectively, thereby exerting a waveform pressure in a particular direction.

2. The device according to claim 1, wherein the balls in the pressure units of the at least one thoracic pressure element are configured to exert a waveform pressure in a direction horizontal to a patient's length axis, and wherein the balls in the pressure units of the at least one abdominal pressure element are configured to exert a waveform pressure in a direction vertical to a patient's length axis.

3. The device according to claim 1 comprising two abdominal and two thoracic pressure elements configured to be arranged in front and/or behind the patient's body.

4. The device according to claim 1, wherein the pressure elements comprise two, three, four, five or six units, capable of exerting pressure on the patient's body.

5. The device according to claim 1, wherein the abdominal pressure element is in the form of a belt, a trouser or a diaper.

6. The device according to claim 1, wherein the thoracic pressure element is in the form of a belt, a shirt or a vest.

7. The device according to claim 1, which is affixed on a support.

8. The device according to claim 7, wherein the support is in the form of a bag or a container, which may be closed.

9. The device according to claim 1, wherein the pulsatile generator is a pneumatic and/or an electromechanical generator, which triggers regular impulses.

10. A method for restoring heart beat in a patient, the method comprising the steps of (a) providing a device according to claim 1, (b) applying the abdominal pressure element on or around the patient's trunk;

(c) applying the thoracic pressure element on or around the patient's thorax;

(d) initiating the pulsatile generator to convey impulses to the pressure elements so that the units capable of exerting pressure on the patient's body start to initiate pressure on the patient's body.

11. The method of claim 10, wherein the units of the at least one abdominal pressure element and the units of the at least one thoracic pressure element capable of exerting pressure on the patient's body create a pressure wave on the patient's body initiated at the abdominal pressure element.

12. The method according to claim 10, wherein the patient is a SCA patient.

* * * * *